US010998128B2

(12) United States Patent
Akimoto

(10) Patent No.: US 10,998,128 B2
(45) Date of Patent: May 4, 2021

(54) IGNITION COIL FOR INTERNAL COMBUSTION ENGINE

(71) Applicant: DENSO CORPORATION, Kariya (JP)

(72) Inventor: Katsunori Akimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 163 days.

(21) Appl. No.: 16/178,880

(22) Filed: Nov. 2, 2018

(65) Prior Publication Data

US 2019/0139700 A1 May 9, 2019

(30) Foreign Application Priority Data

Nov. 8, 2017 (JP) ..... JP2017-215869

(51) Int. Cl.

| | |
|---|---|
| ***H01F 38/12*** | (2006.01) |
| ***H01F 27/02*** | (2006.01) |
| *F02P 13/00* | (2006.01) |
| *F02P 3/02* | (2006.01) |

(52) U.S. Cl.

CPC ..... *H01F 38/12* (2013.01); *H01F 27/022* (2013.01); *F02P 3/02* (2013.01); *F02P 13/00* (2013.01)

(58) Field of Classification Search

CPC ..... H01F 27/02; H01F 27/022; H01F 38/12; F02P 3/02; F02P 13/00

See application file for complete search history.

(56) References Cited

U.S. PATENT DOCUMENTS

| | | | | |
|---|---|---|---|---|
| 7,777,604 | B2 * | 8/2010 | Matsubayashi ..... | H01F 27/022 336/110 |
| 7,849,843 | B2 * | 12/2010 | Kojima ..... | H01F 38/12 123/635 |
| 2012/0227715 | A1 | 9/2012 | Kawai et al. | |

FOREIGN PATENT DOCUMENTS

| | | |
|---|---|---|
| JP | 10-257631 | 9/1998 |
| JP | 2000-205097 | 7/2000 |
| JP | 2006-250028 | 9/2006 |

* cited by examiner

*Primary Examiner* — Hung Q Nguyen
*Assistant Examiner* — Mark L. Greene
(74) *Attorney, Agent, or Firm* — Nixon & Vanderhye PC

(57) ABSTRACT

An ignition coil for an internal combustion engine is provided which includes a case, a connector, a resinous member, and a retainer. The case is equipped with an opening portion and has component parts mounted therein. The connector is electrically connected to an external device. The resinous member is disposed in the case. The retainer firmly hold an external connecting member joined to the connector. The retainer is mechanically discrete from the case and secured to an attachment wall of the case. The attachment wall is defined by at least one of a wall of the case which constitutes the opening portion and a wall secured to the opening portion. The retainer has a portion embedded in the resinous member. This structure minimizes fretting wear between terminals of the connector and the external connecting member such as a wire harness.

9 Claims, 24 Drawing Sheets

IGNITION COIL FOR INTERNAL COMBUSTION ENGINE

CROSS REFERENCE TO RELATED DOCUMENT

The present application claims the benefit of priority of Japanese Patent Application No. 2017-215869 filed on Nov. 8, 2017, the disclosure of which is incorporated herein by reference.

BACKGROUND

1 Technical Field

This disclosure relates generally to an ignition coil for internal combustion engines.

2 Background Art

Internal combustion engines for automotive vehicles usually use an ignition coil to apply a high-voltage to a spark plug to discharge an electric spark. The ignition coil is equipped with an electrical connector for connecting the ignition coil with an external device. A wire harness is joined to the connector to connect the ignition coil and the external device together.

Japanese Patent First Publication No. 2006-250028 teaches an ignition coil mount equipped with a bracket and protectors. The bracket has ignition coils fastened thereto. The protectors are attached to the bracket. Wire harnesses are secured to the protectors.

When the internal combustion engine vibrates, it may result in a phase difference in vibration between each of the ignition coils and one of the wire harness on the ignition coil mount, which leads to fretting wear to occur between a terminal of a connector of each of the ignition coils and a terminal of a corresponding one of the wire harnesses.

SUMMARY

It is an object of this disclosure to provide an ignition coil for internal combustion engines which is designed to minimize fretting wear between a terminal of a connector and a terminal of a wire harness joined to the connector.

According to one aspect of this disclosure, there is provided an ignition coil for an internal combustion engine which comprises: (a) a case in which component parts are disposed and which has an opening portion; (b) a connector which is used to achieve an electrical connection with an external device; (c) a resinous member which is disposed in the case; and (d) a retainer which retains an external connecting member joined to the connector.

The retainer is mechanically discrete from the case and secured to an attachment wall that is at least one of a wall of the case which constitutes the opening portion and a wall attached to the opening portion The retainer has a portion embedded in the resinous member.

The ignition coil for use in internal combustion engines is, as described above, equipped with the retainer which retains the external connecting member. The retainer is secured to the attachment wall and has the portion embedded in the resinous member. The retainer is, therefore, firmly held by the attachment wall and the resinous member, which causes the ignition coil and the external connecting member joined to the ignition coil to mechanically vibrate together upon occurrence of vibration of the internal combustion engine, thereby minimizing the fretting wear between terminals of the connector and the external connecting member.

The retainer is mechanically discrete from the case. In other words, the retainer is formed as a member separate from the case, thereby eliminating the need for making the case into a special shape. This enables the ignition coil to be produced at low costs, that is, to have high productivity.

The ignition coil may be designed easily to match the configuration of the internal combustion engine by changing the layout of the retainer. It is, thus, possible to use the ignition coil with various types of internal combustion engines.

As apparent from the above discussion, the ignition coil is capable of minimizing the fretting wear between the terminals of the connector and the external connecting member such as a wire harness.

In this disclosure, symbols in brackets represent correspondence relation between terms in claims and terms described in embodiments which will be discussed later, but are not limited only to parts referred to in the disclosure.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
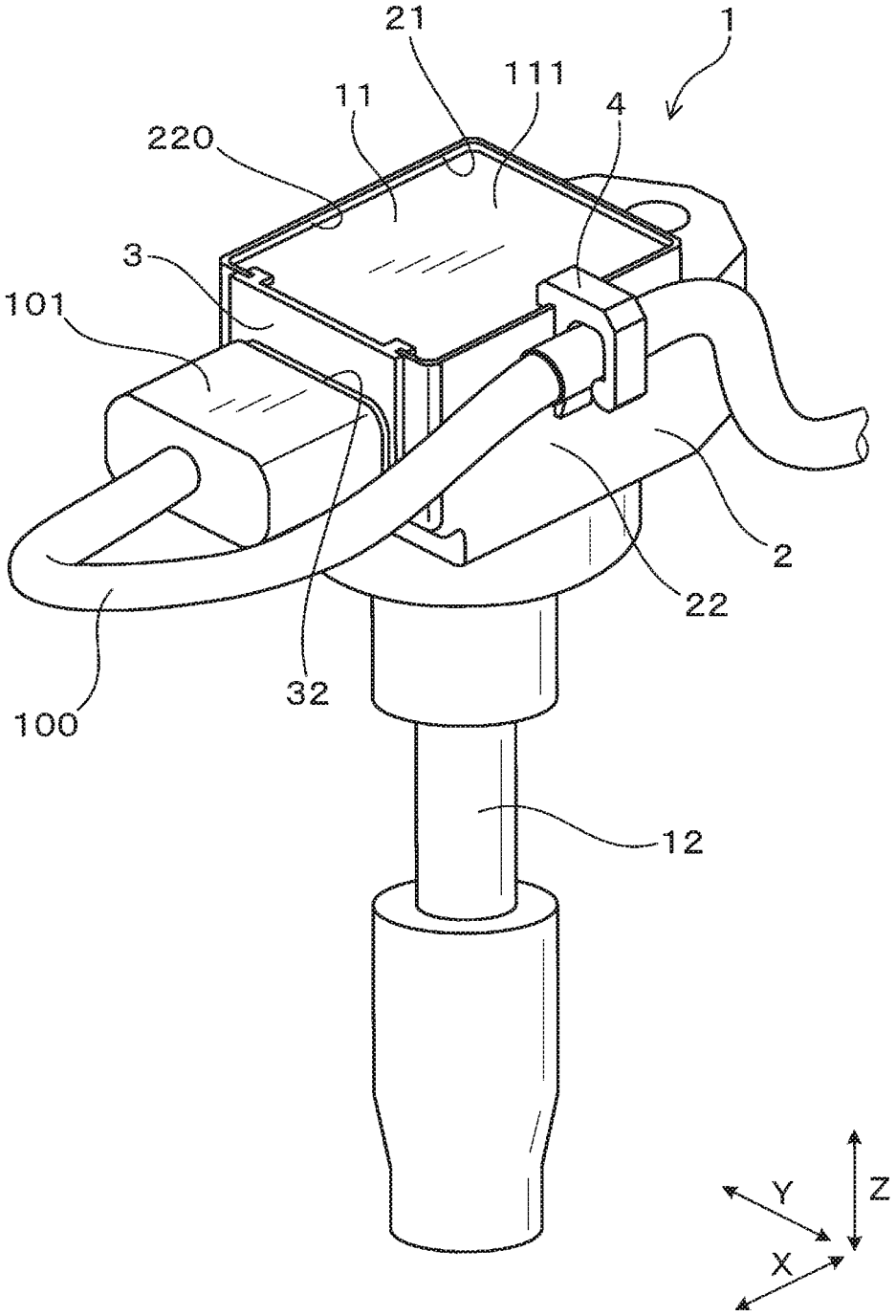
FIG. 1 is a perspective view which illustrates an ignition coil and an external connecting member joined to the ignition coil in the first embodiment.

Embodiments will be described below with reference to the drawings.

First Embodiment

The ignition coil 1 for internal combustion engines according to the first embodiment will be described below with reference to FIGS. 1 to 5. The ignition coil 1, as illustrated in FIG. 2, includes the case 2, the connector 3, the resinous member 11, and the retainer 4. The case 2 is, as illustrated in FIG. 5, equipped with the opening portion 21 and has component parts disposed therein. The connector 3 is, as shown in FIG. 3, electrically connected to an external device. The case 2 is filled with the resinous member 11. The retainer 4 serves as a holder to firmly hold therein the external connecting member 100 which is joined to the connector 3.

Figure 2:
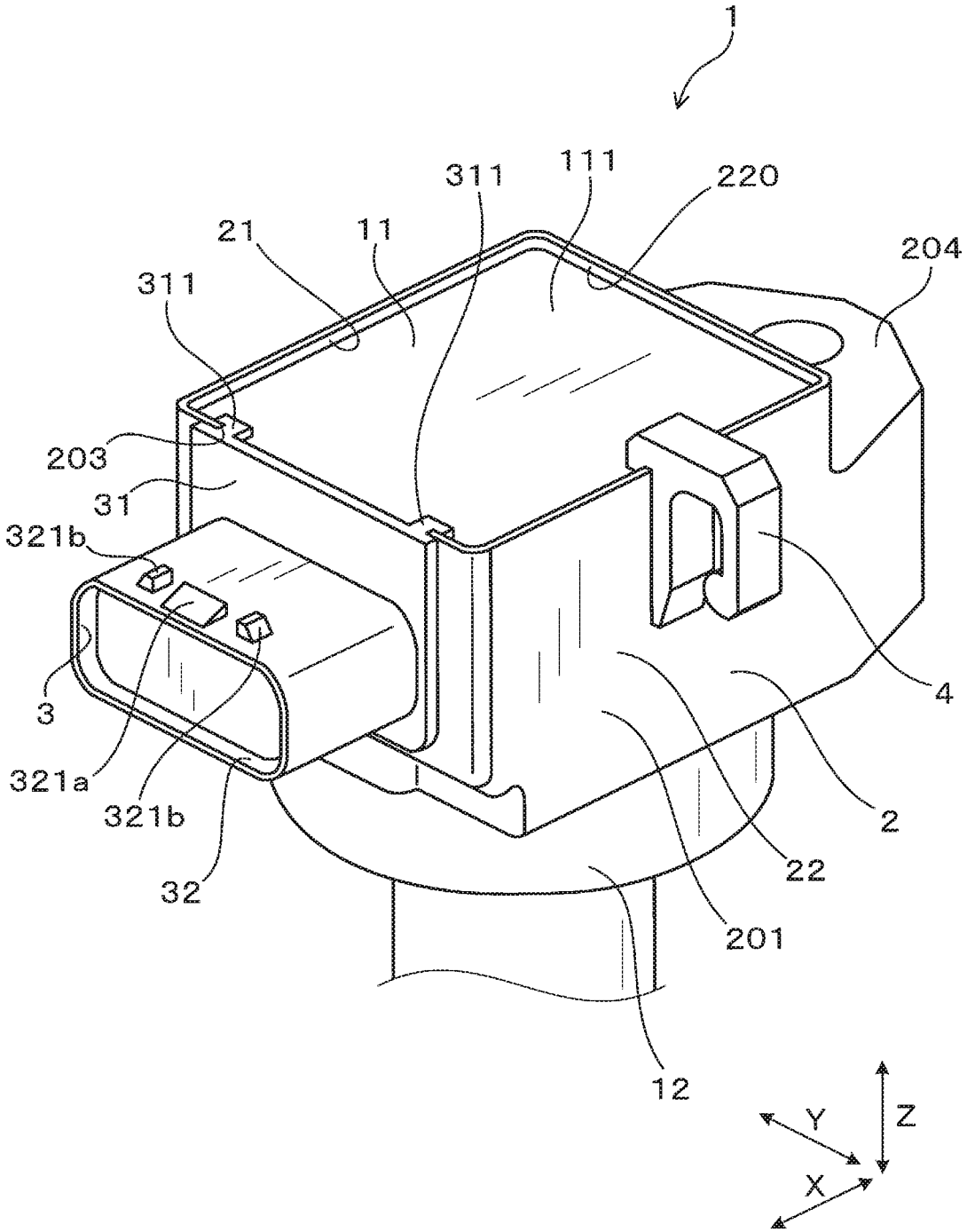
FIG. 2 is a perspective view which illustrates an ignition coil in the first embodiment.
Figure 3:
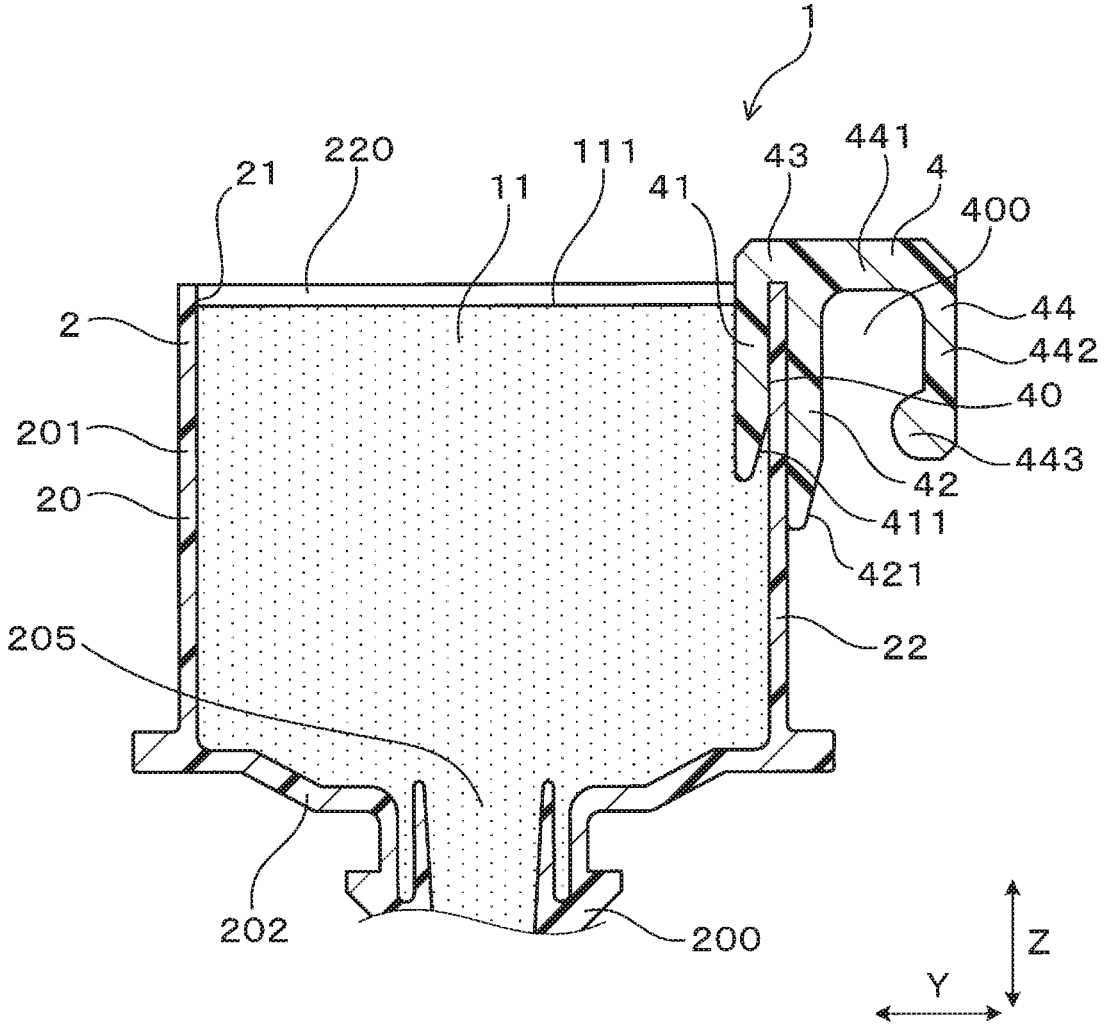
FIG. 3 is a longitudinal sectional view of an ignition coil in the first embodiment.

The retainer 4 is, as clearly illustrated in FIGS. 1 to 3, mechanically discrete from the case 2. The retainer 4 is secured to the attachment wall 22. The attachment wall 22 is a portion of a wall of the casing 2 which defines the opening portion 21. The retainer 4 is partially embedded in the resinous member 11. FIG. 3 omits the component parts of the ignition coil 1.

The ignition coil 1 will be described below in detail. The ignition coil 1 is connected to a spark plug mounted in an internal combustion engine for use in automotive vehicles or cogeneration systems and works to apply high-voltage to the spark plug.

The case 2, as illustrated in FIG. 3, includes the case body 20 and the hollow cylindrical high-voltage tower 200. The case body 20 surrounds the component parts of the ignition coil 1 within the case 2. The high-voltage tower 200 extends from the case body 20. The case 2 is made from PBT (Polybutylene Terephthalate) resin. FIGS. 1 and 2 illustrate the high-voltage tower 200 to which the joint 12 is secured. The joint 12 connects the spark plug and the case 2 together to achieve an electrical connection between the ignition coil 1 and the spark plug.

In the following discussion, a direction in which the high-voltage tower 200 extends from the case body 20 will be referred to below as a vertical direction. Z. A portion of the case 2 where there is the high-voltage tower 200 will also be referred to a lower portion or lower side, while another portion of the case 2 opposite the lower side in the vertical direction Z will also be referred to as an upper portion or upper side. This orientation of the case 2 does not limit the orientation of the ignition coil 1 to the internal combustion engine.

The case body 20, as clearly illustrated in FIGS. 3 and 5, has the side walls 201 which surround the component parts of the ignition coil 1 in a direction perpendicular to the vertical direction Z and the bottom wall 202 which extends from lower ends of the side walls 201 to cover lower sides of the component parts of the ignition coil 1.

The side walls 201, as clearly illustrated in FIGS. 2 and 5, have upper end portions which constitute the opening portion 21. One of the side walls 201, as can be seen in FIG. 5, has formed therein the fitting opening 203 which faces in a direction perpendicular to the vertical direction Z and in which the connector 3 is fit. The fitting opening 203 is formed by cutting the one of the side walls 201 downward from an upper end thereof and constitutes a portion of the opening portion 21 of the case 2. One of the side walls 201 which is opposed to the fitting opening 203 has formed thereon the flange 204 for use in attaching the ignition coil 1 to the internal combustion engine.

The bottom wall 202, as illustrated in FIG. 3, has the through-hole 205 passing through a middle portion thereof in the vertical direction Z. The high-voltage tower 200 extends downward from around the through-hole 205 and communicates with the inner chamber of the case body 20.

The connector 3 is a connector which electrically connects the ignition coil 1 with an ECU (Electronic Control Unit) serving as a controller. The connector 3, as illustrated in FIG. 2, has the attachment wall 31 and the hollow cylindrical protrusion 32. The attachment wall 31 engages the fitting opening 203. The protrusion 32 extends outwardly from the attachment wall 31 in a direction perpendicular to the vertical direction Z and lies outside the case 2. The protrusion 32 is used as a housing of the connector 3.

In the following discussion, a direction which is perpendicular to the vertical direction Z and in which the protrusion 32 of the connector 3 of the ignition coil 1 extends will be referred to as a longitudinal direction X. A direction perpendicular both to the longitudinal direction X and to the vertical direction Z will be referred to as a lateral direction Y.

The attachment wall 31 is made of a rectangular plate and has formed in a circumferential surface thereof the groove 311 in which an edge of the side wall 201 defining the periphery of the fitting opening 203 is fit. The attachment wall 31 surrounds the component parts of the ignition coil 1 in a direction perpendicular to the vertical direction Z along with the side walls 201. In other words, the attachment wall 31 forms a housing in which the component parts of the ignition coil 1 are disposed along with the side walls 201 of the case 2.

Although not illustrated in the drawings, the protrusion 32 has a plurality of male terminals disposed therein. The male terminals pass through the attachment wall 31. The protrusion 32 and the attachment wall 31 are formed integrally with each other.

The external connector 101 is, as clearly illustrated in FIG. 1, joined to the protrusion 32 of the connector 3. The external connector 10 is an end of the external connecting member 100. The protrusion 32, as clearly illustrated in FIG. 2, has formed thereon the lock 321*a* and the guides 321*b*. The lock 321*a* engages the external connector 101 to achieve a firm joint therebetween. Upon engagement of the protrusion 32 and the external connector 101, the male terminals of the connector 3 are inserted or fitted into female terminals, not shown, disposed in the external connector 101. When the male terminals are inserted into the female terminals, the female terminals are placed in elastic contact with the male terminals. The external connecting member 100 is made of a wire harness and electrically connected to the ECU.

The case body 20, as illustrated in FIGS. 2 and 3, has the resinous member 11 disposed therein to hermetically seal the component parts of the ignition coil 1. The ignition coil 1 has formed therein the resin-exposing opening portion 220 which is defined by at least a part of the opening portion 21. The resinous member 11 has an upper surface 111 which is exposed upward outside the ignition coil 1 through the resin-exposing opening portion 220. The upper surface 111 will also be referred to below as an exposed surface. The resin-exposing opening portion 220 is shaped to expose the whole of the exposed surface 111 of the resinous member 11 outside the case 2.

The resinous member 11 is, as can be seen in FIG. 2, fully disposed in the case 2 to have the exposed surface 111 lying near the opening portion 21 at the upper ends of the side walls 201 of the case 2. In other words, the resin-exposing opening portion 220 surrounds the entire circumference of the exposed surface 111 along with the opening portion 21 at the upper ends of the side walls 201 and an upper end of the attachment wall 31.

The retainer 4 is discrete from the wall of the case 2 which constitutes the resin-exposing opening portion 220. The retainer 4 is attached from the resin-exposing opening portion 220 to the attachment wall 22 which constitutes a portion of the resin-exposing opening portion 220. In other words, the retainer 4 is discrete from the side walls 201 and the attachment wall 31 which form the resin-exposing opening portion 220. In this embodiment, one of the side walls 201 facing the lateral direction Y constitutes the attachment wall 22. The retainer 4 lies at a middle portion of the attachment wall 22 in longitudinal direction X.

Figure 4:
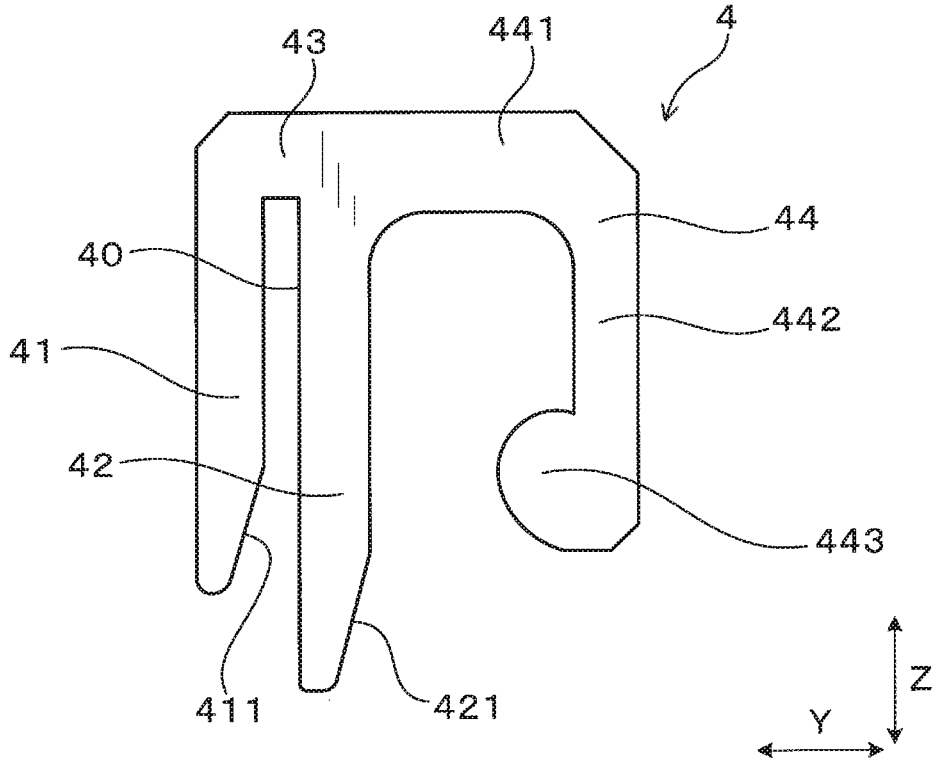
FIG. 4 is a front view which illustrates a retainer in the first embodiment.
Figure 5:
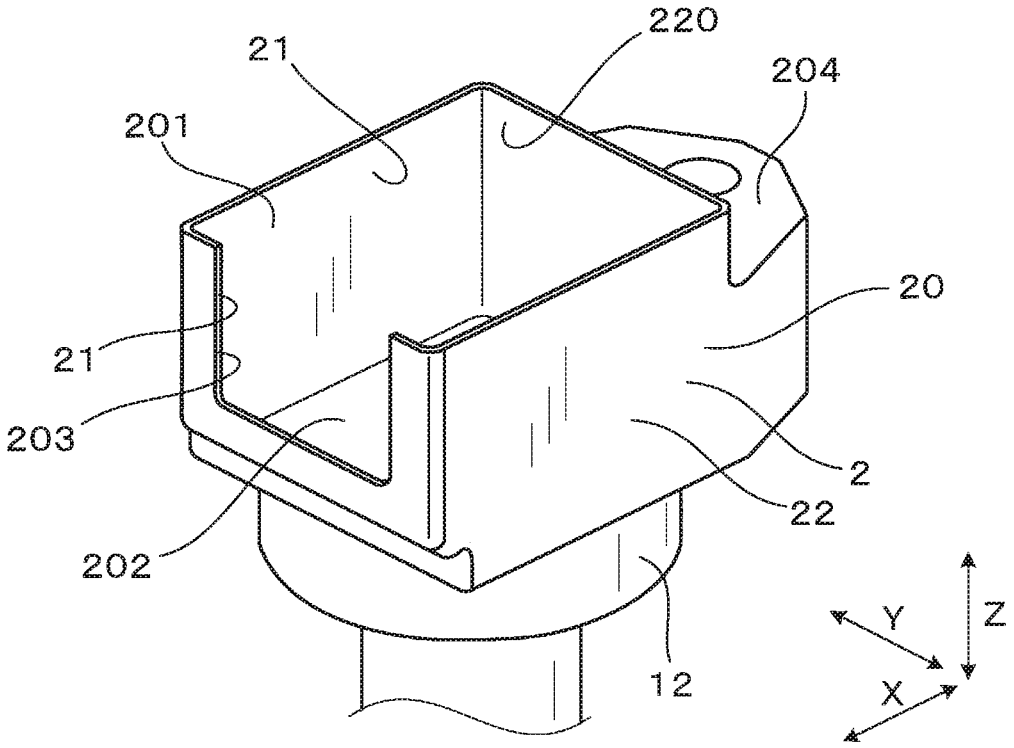
FIG. 5 is a perspective view which illustrates a case and a joint in the first embodiment.

The retainer 4 is, as illustrated in FIGS. 3 and 4, made up of the first portion 41, the second portion 42, the third portion 43, and the fourth portion 44 which will be described later in detail. The first portion 41 is, as can be seen in FIG. 3, arranged inside the case 2. The first portion 41 is at least partially embedded in the resinous member 11. In this embodiment, substantially the whole of the first portion 41 is embedded in the resinous member 11. The second portion 42 grasps the attachment wall 22 along with the first portion 41. The third portion 43 is located above or on an open end (i.e., an upper end) of the resin-exposing opening portion 200 of the attachment wall 22 and serves as a joint which physically connects the first portion 41 and the second portion 42. The first portion 41, the second portion 42, and the third portion 43 constitute the U-shaped clip with an opening facing downward, that is, in a direction opposite the open end of the resin-exposing opening portion 220. The fourth portion 44 defines the holding recess 400 which is of a U-shape and retains the external connecting member 100.

The first portion 41, as clearly illustrated in FIG. 3, extend along an inner surface of the attachment wall 22. The first portion 41 has a lower end with the tapered surface 411 which faces the attachment wall 22 and is located farther away from the attachment wall 22 as approaching a lower tip of the first portion 41.

The second portion 42, as clearly illustrated in FIG. 3, extends along an outer surface of the attachment wall 22. The second portion 42 has a length longer than that of the first portion 41 to have a lower end located below that of the first portion 41. Specifically, the lower end of the second portion 42 lies at substantially a middle of the attachment wall 22 in the vertical direction Z. The lower end of the second portion 42 has the tapered surface 421 which is opposed to the attachment wall 22 and is located closer to the attachment wall 22 as approaching a lower tip of the second portion 42.

The third portion 43 extends in the lateral direction Y to connect between upper ends of the first portion 41 and the second portion 42. With the above arrangements of the retainer 4, the first portion 41, the second portion 42, and the third portion 43 form the U-shaped clip 40 which opens downward and functions as a holder or gripper. The clip 40 has an inner void opening at sides thereof opposed to each other in the longitudinal direction X.

The retainer 4 is shaped so that the wall of the case 2 is press-fit therein. Specifically, the retainer 4 has the attachment wall 22 press-fit in the clip 40. When the retainer 4 is secured to the attachment wall 22 so as to have the attachment wall 22 inserted into the clip 40, the tapered surface 411 of the first portion 41 serves to guide the movement of the attachment wall 22 into the clip 40.

The fourth portion 44 is, as clearly illustrated in FIGS. 3 and 4, located on the opposite side of the second portion 42 to the first portion 41 in the lateral direction Y. Specifically, the fourth portion 44 is of an L-shape which includes the lateral section 441 and the vertical section 442. The lateral section 441 extends from the upper end of the second portion 42 in the lateral direction Y. The vertical section 442 extends downward from an end of the lateral section 441. The lower end of the vertical section 442 is equipped with the bulge 44 (which will also be referred to as a semicircular portion) which has a semicircular cross section. The bulge 44 faces the second portion 42. A minimum distance between the bulge 443 and the second portion 42 is set slightly shorter than a diameter of a portion the external connecting member 100 which is fit in the retainer 4.

The fourth portion 44 and the second portion 42, as illustrated in FIG. 3, form the gripper 400 in the shape of a substantially U-shaped recess. As apparent from the above discussion, the fourth portion 44 constitutes the gripper 400 along with a portion of the clip 40. The gripper 400 is of a U-shape opening downward and has an inner void opening at sides of the retainer 4 opposed to each other in the longitudinal direction X.

The gripper 400 lies at an upper end portion of the attachment wall 22 in the vertical direction Z. The retaining of the external connecting member 100 in the retainer 4 is achieved by pressing the external connecting member 100 into the gripper 400 from below it in the vertical direction Z. When the external connecting member 100 is pressed into the gripper 400, the tapered surface 421 of the second portion 42 serves to guide the movement of the external connecting member 100 into the gripper 400.

The first portion 41, the second portion 42, the third portion 43, and the fourth portion 44, as can be seen in FIG. 2, have the same dimension in the longitudinal direction X. Each of the first portion 41, the second portion 42, the third portion 43, and the fourth portion 44 has a first side surface and a second side surface which are opposed to each other in the longitudinal direction X. The first side surfaces of the first portion 41, the second portion 42, the third portion 43, and the fourth portion 44 are laid flush with each other in the lateral direction Y. Similarly, the second side surfaces of the first portion 41, the second portion 42, the third portion 43, and the fourth portion 44 are laid flush with each other in the lateral direction Y. The first portion 41, the second portion 42, the third portion 43, and the fourth portion 44 have the upper ends lying flush with each other in the lateral direction Y. In this embodiment, the retainer 4 is formed in an E-shape as a whole.

The retainer 4 is made from resin material in this embodiment. Specifically, the retainer 4 is made from the same material (i.e., PBT resin) as that of the case 2, but may alternatively be formed by material different from that of the case 2. The resinous member 11 is made from material which will be tightly adhered to the retainer 4. The resinous member 11 is made from thermoset resin, such as epoxy resin.

Although not illustrated in the drawings, the high-voltage tower 200 has disposed therein a high-voltage terminal which closes the through-hole 205 in the vertical direction Z. The high-voltage terminal serves to block downward leakage of the material of the resinous member 11 below the high-voltage terminal in the high-voltage tower 200. The high-voltage terminal is electrically conductive in the vertical direction Z and functions as an output terminal of the ignition coil 1.

Although not illustrated in the drawings, the component parts of the ignition coil 1 include a primary winding, a secondary winding, a center core, an outer core, and an igniter. The primary winding and the secondary winding are magnetically coupled with each other. A high-voltage side of the secondary winding is electrically connected to the high-voltage terminal. The center core is disposed inside, for example, the primary winding. The outer core is arranged to fully surround the primary winding and the secondary winding. The igniter works to electrically energize or deenergize the primary winding.

In the production of the ignition coil 1, the material of the resinous member 11 is casted into the case 2 after the retainer 4 is secured to the attachment wall 22 in this embodiment, but however, it may be made in reverse order.

The ignition coil 1 offers the following beneficial advantages.

The ignition coil 1 for use in internal combustion engines in this embodiment is equipped with the retainer 4 which retains the external connecting member 100. The retainer 4 is secured to the attachment wall 22 and has a portion embedded in the resinous member 11. The retainer 4 is, therefore, firmly held by the attachment wall 22 and the resinous member 11, which causes the ignition coil 1 and the external connecting member 100 joined to the ignition coil 1 to mechanically vibrate together upon occurrence of vibration of the internal combustion engine, thereby minimizing the fretting wear between the terminal of the connector 3 and the terminal of the external connecting member 100.

The retainer 4 is discrete from the case 2. In other words, the retainer 4 is formed as a member separate from the case 2, thereby eliminating the need for making the case 2 into a special shape. This enables the ignition coil 1 to be produced at low costs, that is, to have high productivity.

The ignition coil 1 may be designed easily to match the configuration of the internal combustion engine by changing the layout of the retainer 4. It is, thus, possible to use the ignition coil 1 with various types of internal combustion engines.

Figure 6:
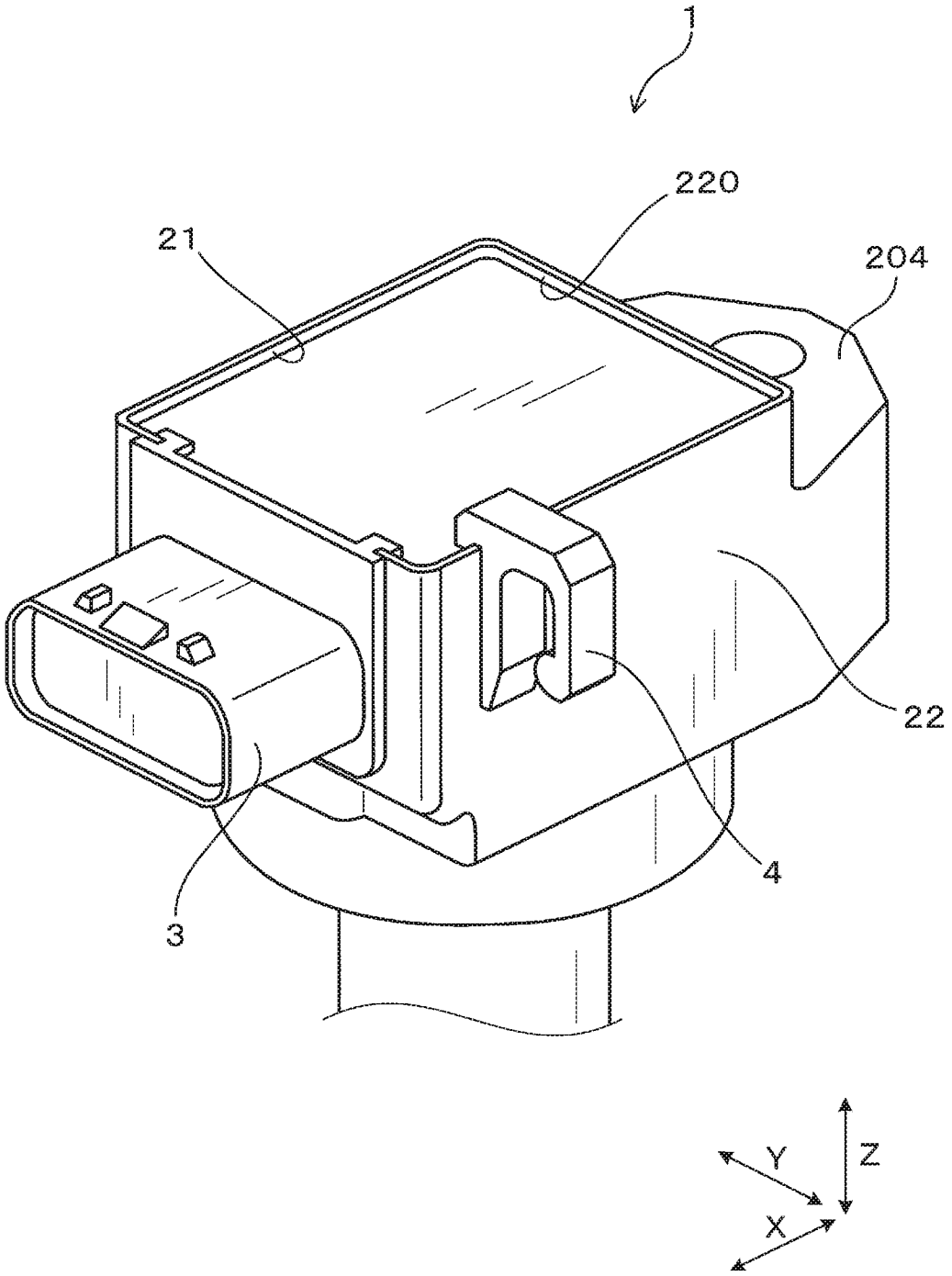
FIG. 6 is a perspective view which illustrates a first modification of an ignition coil of the first embodiment.
Figure 7:
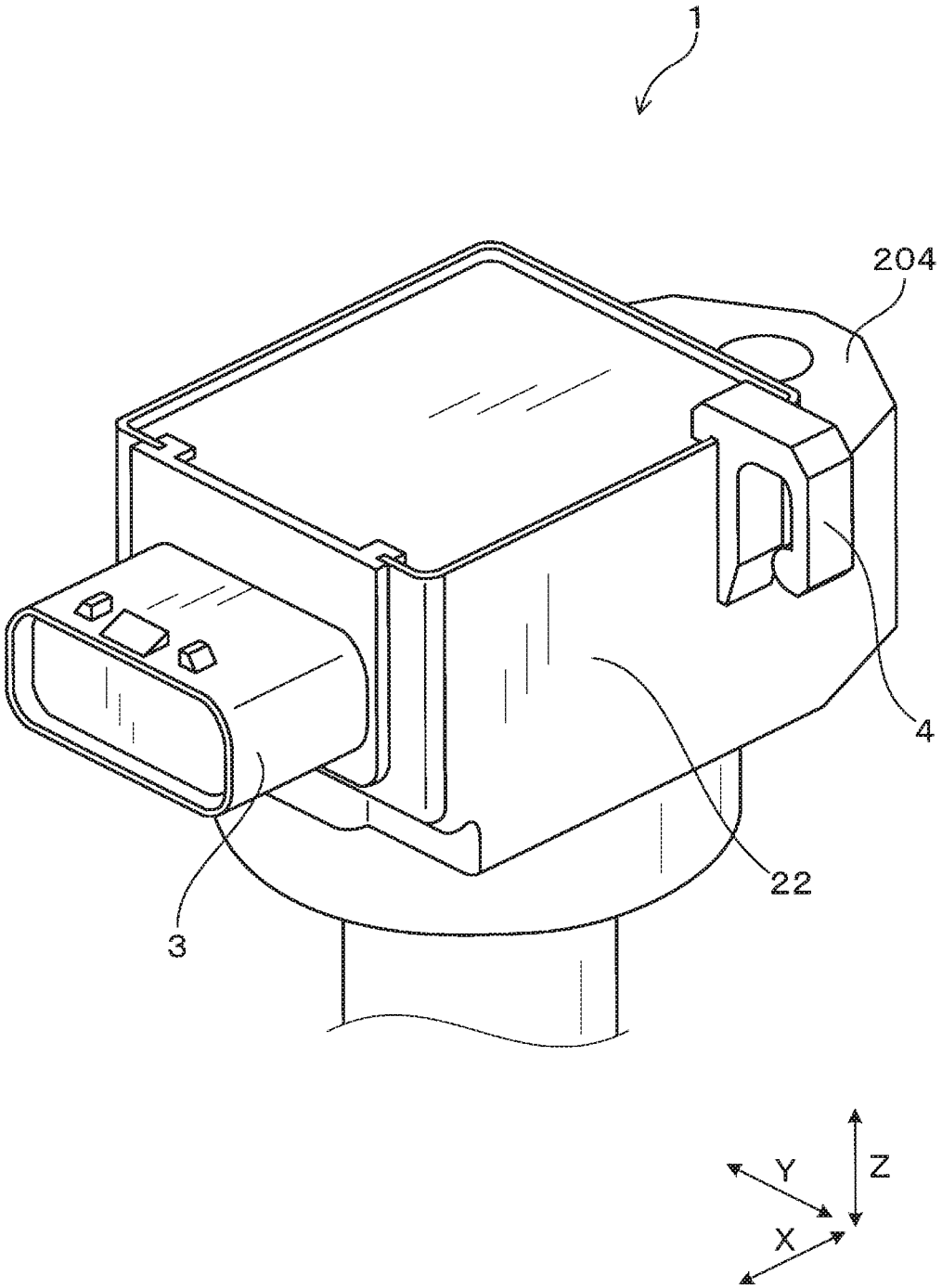
FIG. 7 is a perspective view which illustrates a second modification of an ignition coil of the first embodiment.
Figure 8:
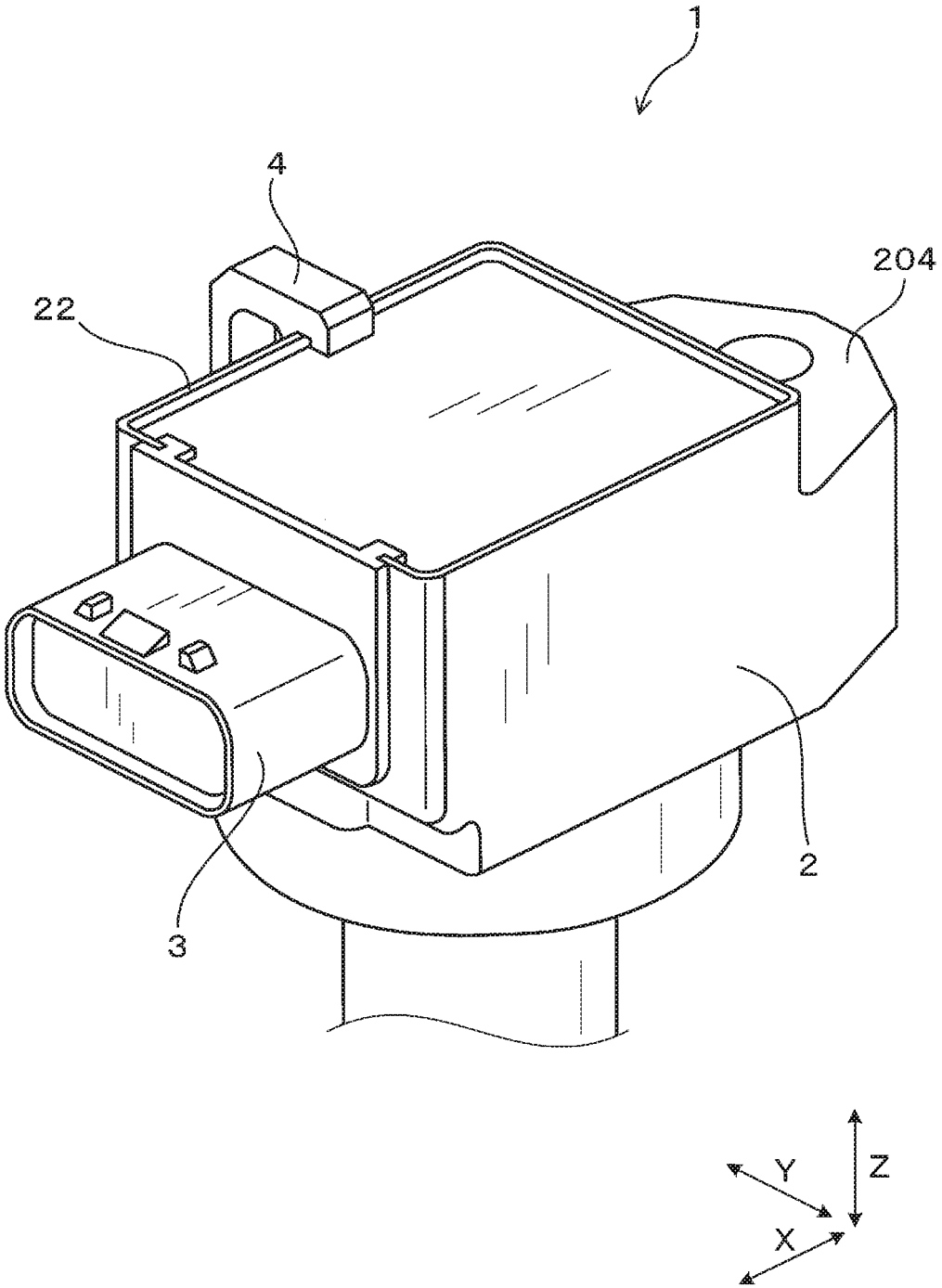
FIG. 8 is a perspective view which illustrates a third modification of an ignition coil of the first embodiment.

For example, the retainer 4 may be, as illustrated in FIG. 6, secured to a portion of the attachment wall 22 which is close to the connector 3 in the longitudinal direction X. The retainer 4 may alternatively be, as illustrated in FIG. 7, a portion of the attachment wall 22 which is close to the flange 204 in the longitudinal direction X. Alternatively, the case 2 may be, as illustrated in FIG. 8, designed to have the attachment wall 22 which is on the opposite side (i.e., the left side in the drawing) of the case body 20 to that shown in FIGS. 6 and 7.

The retainer 4 is made of a member discrete from the wall of the case 2 which constitutes the resin-exposing opening portion 220 and fitted from the resin-exposing opening portion 220 on the attachment wall 22 constituting the resin-exposing opening portion 220. This enables the retainer 4 to be attached to a component (e.g., a case or a connector) of an existing ignition coil which may constitute the resin-exposing opening portion 220 to produce the ignition coil 1 in this embodiment. This facilitates improvement of productivity of the ignition coil 1.

The retainer 4 includes the clip 40 and the gripper 400. The clip 40 is of a U-shape made up of the first portion 41, the second portion 42, and the third portion 43. The retainer 4 also includes the fourth portion 44 which forms the gripper 400. The gripper 400 is of a U-shape and firmly retains the external connecting member 100. This structure enables the retainer 4 which is secured to the attachment wall 22 and retains the external connecting member 100 to be formed into a simple shape.

The retainer 4 is, as described above, press-fitted, i.e., snap-fitted on the attachment wall 22. This reduces a risk that the retainer 4 is accidently removed from the attachment wall 22. The snap-fitting of the retainer 4 on the attachment wall 22 eliminates the need for securing the retainer 4 during a following process in which the resinous member 11 is casted into the case 2, thereby facilitating improvement of the productivity of the ignition coil. 1.

As apparent from the above discussion, the ignition coil 1 for use in internal combustion engines is capable of minimizing the fretting wear between the terminals of the connector 3 and the external connecting member 100.

Second Embodiment

Figure 9:
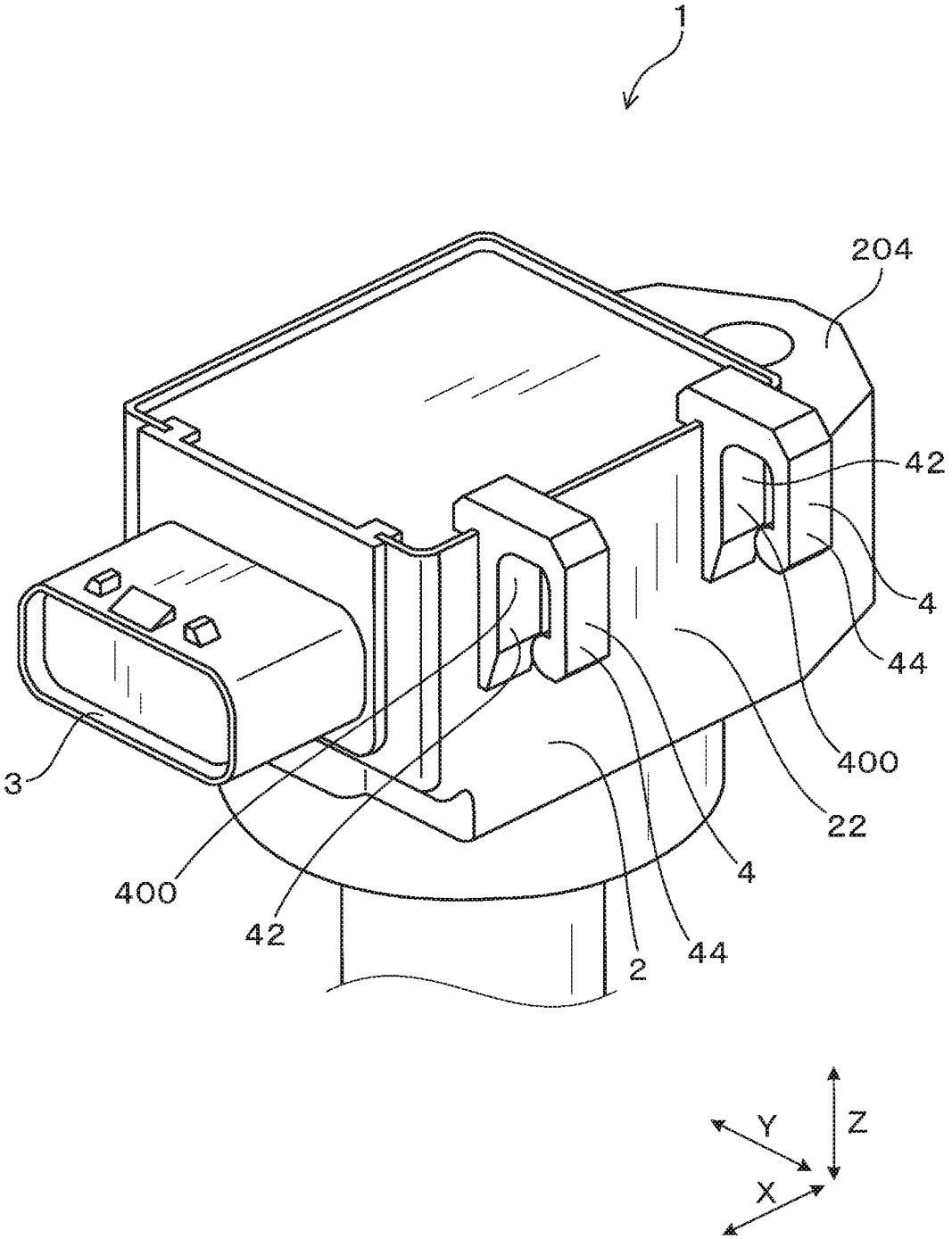
FIG. 9 is a perspective view which illustrates an ignition coil in the second embodiment.

FIG. 9 illustrates the ignition coil 1 according to the second embodiment which is equipped with a plurality of protectors 4 fit on the attachment wall 22.

The protectors 4 are fit on portions of the attachment wall 22 which are located at a given interval away from each other in the longitudinal direction X, in other words, closer to the ends (i.e., the side walls 201) of the case 2 which are opposed to each other in the longitudinal direction X. The protectors 4 are identical in configuration with each other. The protectors 4 are arranged to have inner voids of the grippers 400 aligned with each other in the longitudinal direction X. The external connecting member 100, not shown in FIG. 9, is fitted in the gripper 400 of each of the protectors 4.

Other arrangements are identical with those in the first embodiment, and explanation thereof in detail will be omitted here.

In the second embodiment and following embodiments, the same or similar reference numbers as employed in the first or preceding embodiments refer to the same or similar parts unless otherwise specified.

The structure of the ignition coil 1 of the second embodiment ensures the stability in retaining the external connecting members 100 using the plurality of protectors 4, thereby minimizing a risk that the ignition coil 1 is different in phase of vibration from the external connecting member 100.

The second embodiment offers substantially the same other beneficial advantages as those in the first embodiment.

Third Embodiment

Figure 10:
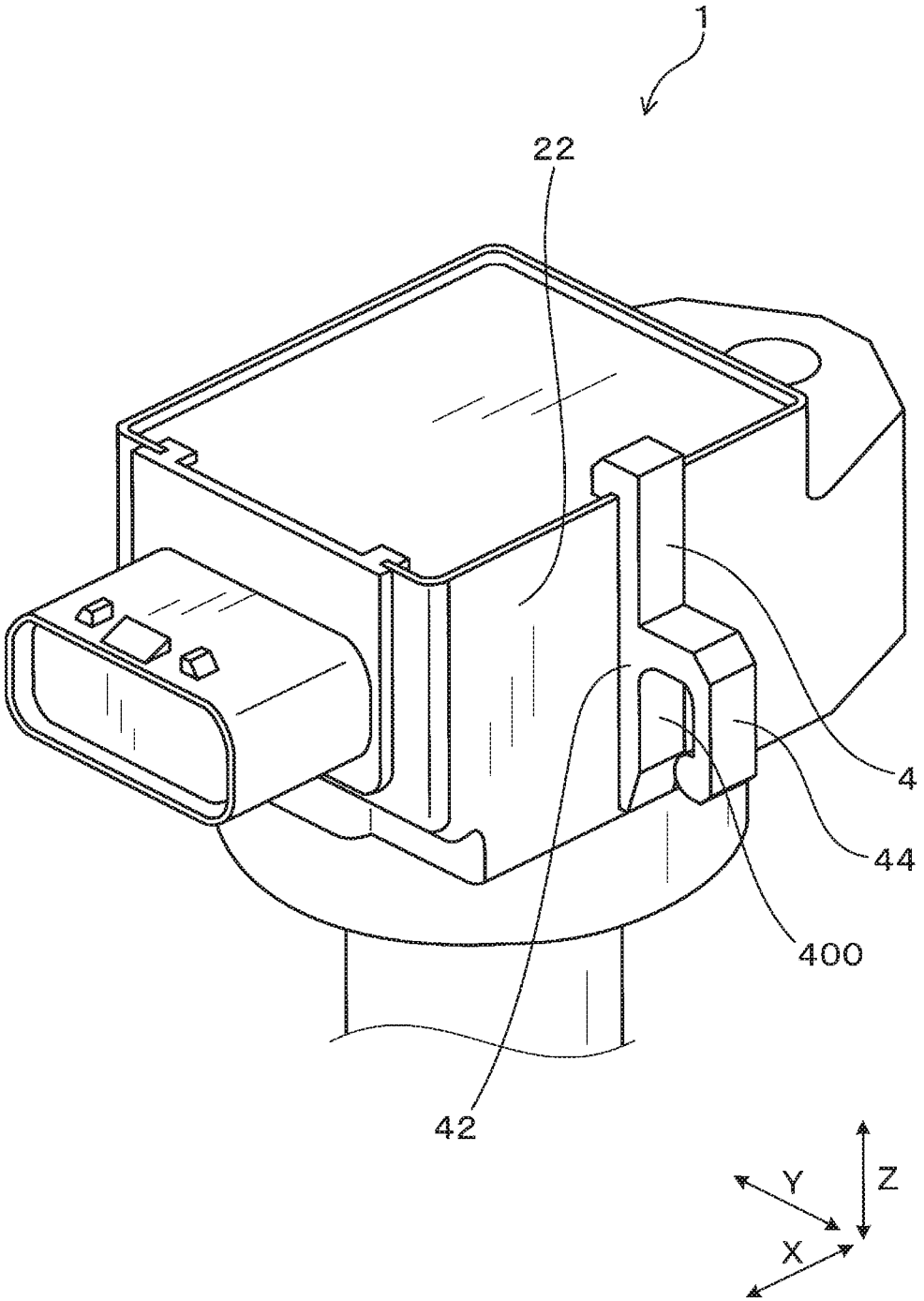
FIG. 10 is a perspective view which illustrates an ignition coil in the third embodiment.
Figure 11:
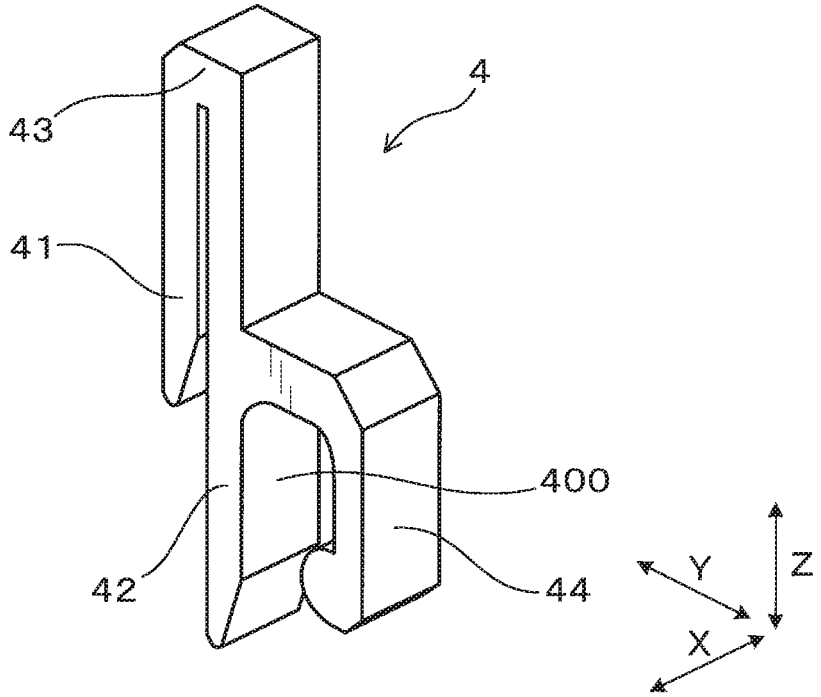
FIG. 11 is a perspective view which illustrates an ignition coil in the third embodiment.

FIGS. 10 and 11 illustrate the ignition coil 1 according to the third embodiment which is different in configuration of the retainer 4 from the first embodiment.

The second portion 42 of the retainer 4 is designed to have a dimension (i.e., length) which is equal to that of the attachment wall 22 in the vertical direction Z. The second portion 42 has a lower end which lies at substantially the same position as that of a lower end of the attachment wall 22 in the vertical direction Z. The gripper 400 lies at a lower portion of the attachment wall 22 in the vertical direction Z. In other words, the gripper 400 is located closer to the lower end of the attachment wall 22 than to the upper end of the attachment wall 22 in the vertical direction Z.

As apparent from the above discussion, the location of the gripper 400 of the retainer 4 may be changed by modifying the configuration of the retainer 4.

Fourth Embodiment

Figure 12:
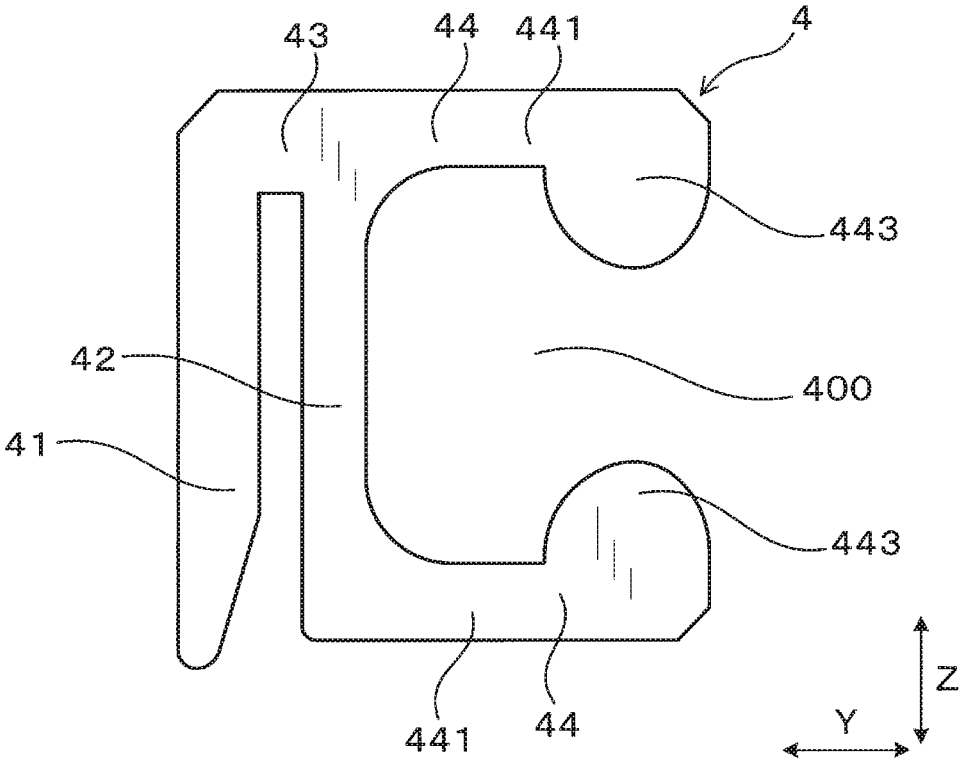
FIG. 12 is a front view which illustrates an ignition coil in the fourth embodiment.

FIG. 12 illustrates the retainer 4 in the fourth embodiment which is different in configuration from that in the first embodiment. Specifically, the retainer 4 includes two fourth portions 44 each of which is arranged in a different way from that in the first embodiment.

Each of the fourth portions 44 includes the lateral section 441 and the bulge 443. The lateral section 441 of one of the fourth portions 44 (which will also be referred to below as a first fourth portion) extends from an upper end of the second portion 42 away from the first portion 41 in the lateral direction Y, while the lateral section 441 of the other fourth portion 44 (which will also be referred to below as a second fourth portion) extends from a lower end of the second portion 42 away from the first portion 41 in the lateral direction Y. The bulges 443 of the fourth portions 44 are oriented face each other, in other words, protrude from the lateral sections 441 close to each other in the vertical direction Z.

The gripper 400 is formed in a U-shape by the second portion 42 and the fourth portions 44 to have an opening facing in a direction away from the first portion 41 in the lateral direction Y. The gripper 400, like in the above embodiment, has an inner void extending through a width thereof in the longitudinal direction X. The retaining of the external connecting member 100, not shown in FIG. 12, in the gripper 400 is achieved by pressing or fitting the external connecting member 100 in the gripper 400 in the lateral direction Y (i.e., toward the first portion 41 to make a snap-fit joint in the gripper 400.

Other arrangements are identical with those in the first embodiment.

The use of the two fourth portions 44 facilitates the ease with which the fourth portions 44 are elastically deformed to move the bulges 443 away from each other in the vertical direction Z upon snap-fitting of the external connecting member 100 in the gripper 400, thereby resulting in a decrease in force required to fitting the external connecting member 100 in the gripper 400.

The fourth embodiment offers substantially the same other beneficial advantages as those in the first embodiment.

Fifth Embodiment

Figure 13:
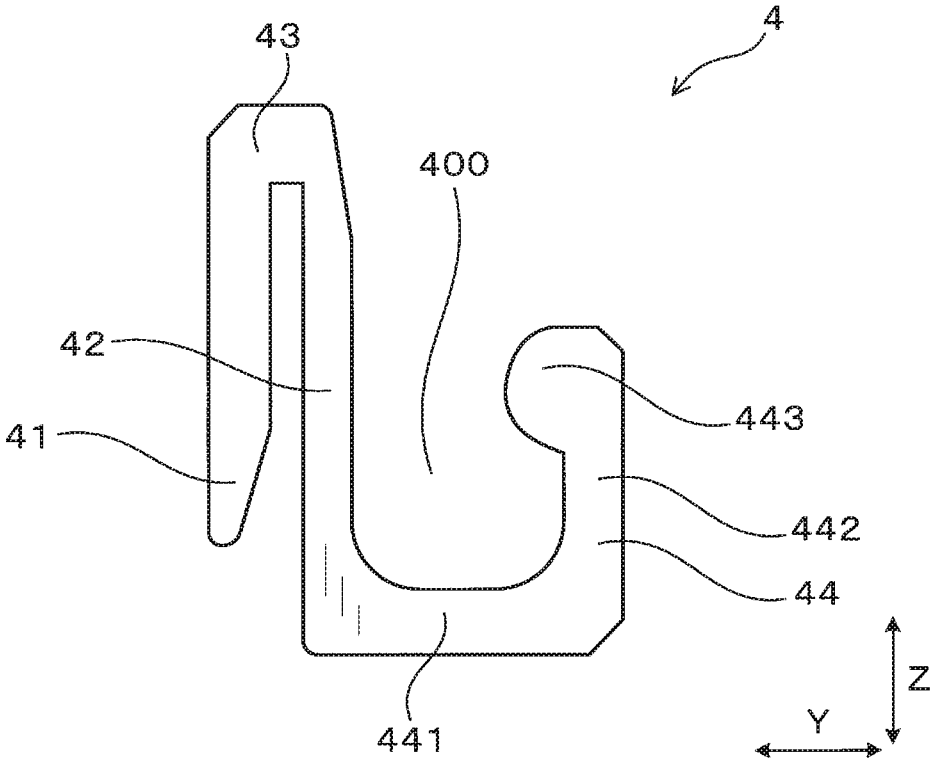
FIG. 13 is a front view which illustrates an ignition coil in the fifth embodiment.

FIG. 13 illustrates the retainer 4 according to the fifth embodiment which is different in configuration from that in the first embodiment.

The fourth portion 44 includes the lateral section 441 and the vertical section 442. The lateral section 441 extends from a lower end of the second portion 42 outward in the lateral direction Y. The vertical section 442 extends from an outer end of the lateral section 441 upward in the vertical direction Z. The vertical section 442 has the bulge 443 which is formed on an upper end thereof and protrudes close to the second portion 42.

The gripper 400 is of a U-shape made up of the second portion 42 and the fourth portion 44 to have an opening facing upward. The gripper 400 has an inner void which extends through a width thereof in the longitudinal direction X. The retaining of the external connecting member 100, not shown in FIG. 13, in the gripper 400 is achieved by pressing or fitting the external connecting member 100 downward from above the gripper 400.

Other arrangements are identical with those in the first embodiment.

The force which is required to snap-fit the external connecting member 100 in the gripper 400 and exerted on the retainer 4 is oriented downward. The force required to fit the clip 40 made up of the first portion 41, the second portion 42, and the third portion 43 on the attachment wall 22 is oriented downward in the same direction as that in which the force acts on the retainer 4 upon the fitting of the external connecting member 100 in the gripper 400, thereby minimizing a risk that the retainer 4 is undesirably removed from the case 2 when the force is exerted downward by the external connecting member 100 on the retainer 4 to fit the external connecting member 100 in the gripper 400.

The fifth embodiment offers substantially the same other beneficial advantages as those in the first embodiment.

Sixth Embodiment

Figure 14:
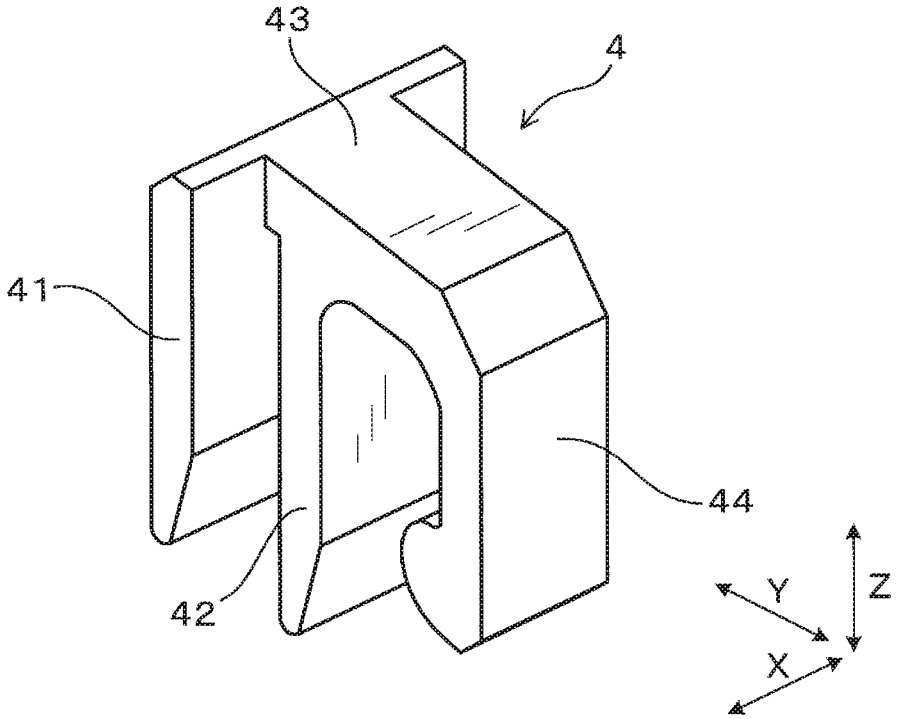
FIG. 14 is a perspective view which illustrates a retainer in the sixth embodiment.

FIG. 14 illustrates the retainer 4 according to the sixth embodiment which is different in configuration from that in the first embodiment.

At least one of the first portion 41, the second portion 42, the third portion 43, and the fourth portion 44 of the retainer 4 is shaped to have a width different from those of the others.

The width of each of the first portion 41, the second portion 42, and the third portion 43 which form the clip 40 is a maximum dimension thereof in the longitudinal direction X in which the clip 40 is viewed to be of a U-shape. The width of the fourth portion 44 is a maximum dimension thereof in the longitudinal direction X in which a combination of a portion of the clip 40 and the fourth portion 44 is viewed to be of a U-shape.

In this embodiment, the width of the first portion 41 is greater than those of the second portion 42, the third portion 43, and the fourth portion 44.

Other arrangements are identical with those in the first embodiment.

At least one of the first portion 41, the second portion 42, the third portion 43, and the fourth portion 44 is, as described above, shaped to have a width different from those of the others, thereby enabling the retainer 4 to be designed to meet various requirements therefor.

In this embodiment, the first portion 41 which is embedded in the resinous member 11 is shaped to have a greater width, thereby resulting in an increase in area of contact between the first portion 41 and the resinous member 11 to enhance the degree to which the retainer 4 is firmly secured to the ignition coil 1.

Figure 15:
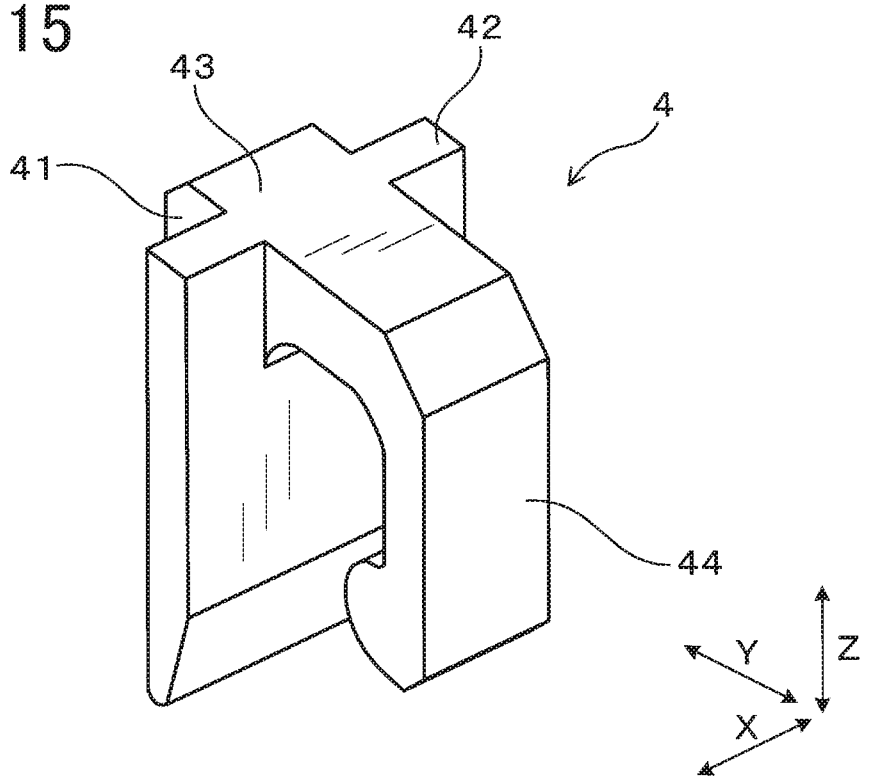
FIG. 15 is a perspective view which illustrates a first modification of a retainer in the sixth embodiment.

The second portion 42 may be, as illustrated in FIG. 15, shaped to have a width greater than those of the first portion 41, the third portion 43, and the fourth portion 44, thereby enhancing the mechanical strength of the retainer 4 using the second portion 42 without sacrificing the flexibility of the first portion 41, the third portion 43, and the fourth portion 44. The first portion 41 and the third portion 43 are each designed to have a smaller width to facilitate elastic deformation of the first portion 41 and the third portion 43 when the retainer 4 is fitted on the attachment wall 22 of the case 2. The smaller width of the fourth portion 44 facilitates elastic deformation of the fourth portion 44 when the external connecting member 100 is fitted in the retainer 4.

Figure 16:
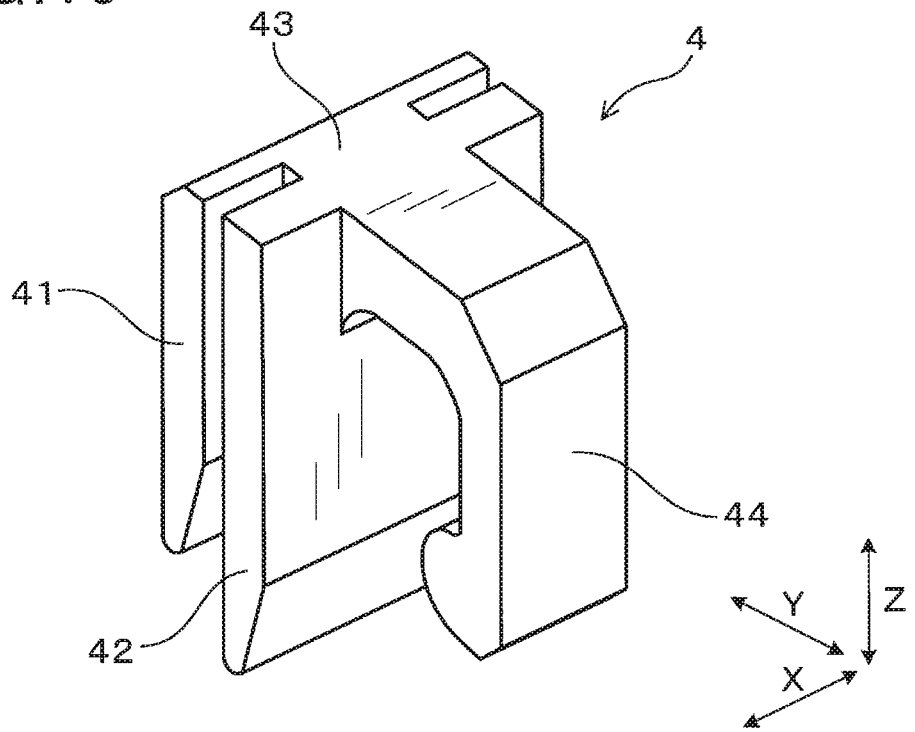
FIG. 16 a perspective view which illustrates a second modification of a retainer in the sixth embodiment.

The first portion 41 and the second portion 42 may be, as illustrated in FIG. 16, each shaped to have a width greater than those of the third portion 43 and the fourth portion 44. This structure, as described already, results in an increase in area of contact of the first portion 41 with the resinous member 11. The second portion 42 serves to increase a mechanical strength of the retainer 4. A smaller width of the third portion 43 facilitates elastic deformation of the first portion 41 and the second portion 42 to increase an interval therebetween when the attachment wall 22 is fitted into the clip 40 made up of the first portion 41, the second portion 42, and the third portion 43.

Figure 17:
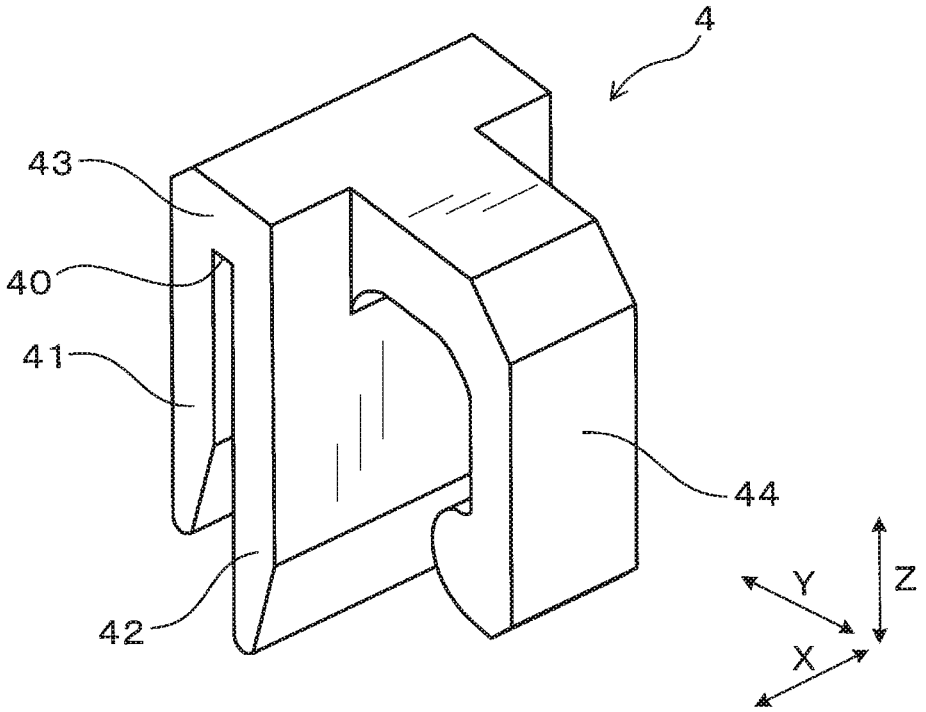
FIG. 17 is a perspective view which illustrates a third modification of a retainer in the sixth embodiment.

The first portion 41, the second portion 42, and the third portion 43 may alternatively be, as illustrated in FIG. 17, each shaped to have a width greater than that of the fourth portion 44. This results in an increase in mechanical strength of the clip 40, thereby enhancing the durability of the clip 40 against press-fitting of the attachment wall 22 into the clip 40.

Figure 18:
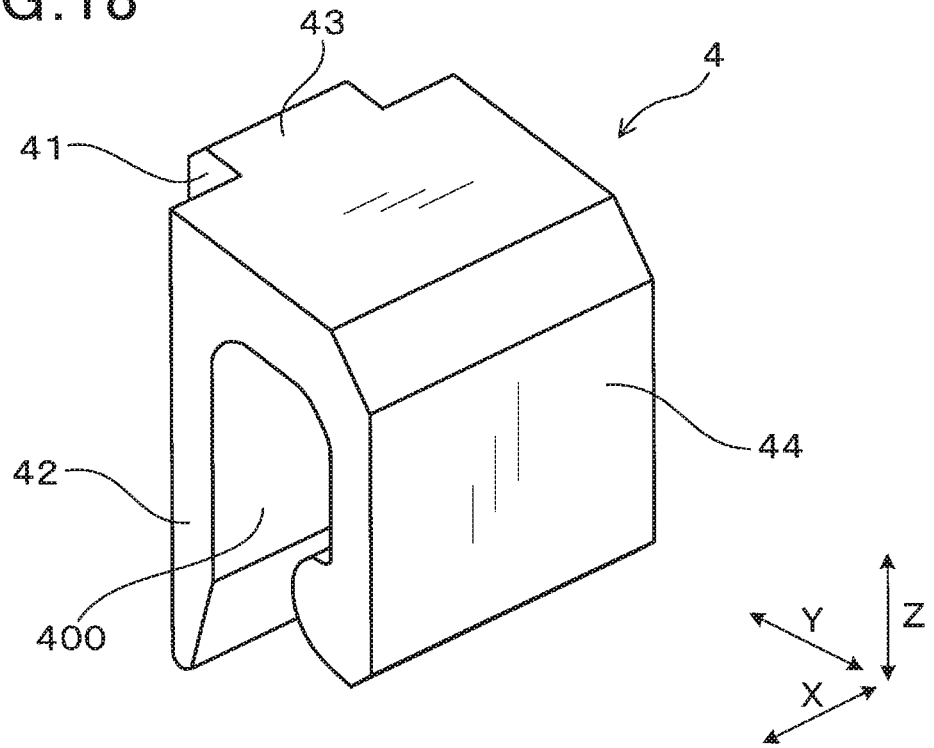
FIG. 18 is a perspective view which illustrates a fourth modification of a retainer in the sixth embodiment.

The second portion 42 and the fourth portion 44 may alternatively be, as illustrated in FIG. 18, each shaped to have a width greater than those of the first portion 41 and the third portion 43. This results in an increase in mechanical strength of the gripper 400 to enhance the durability of the gripper 400 against snap-fitting of the external connecting member 100 into the gripper 400.

As apparent from the above discussion, the retainer 4 may be formed into various shapes in order to meet different needs.

The sixth embodiment offers substantially the same other beneficial advantages as those in the first embodiment.

Seventh Embodiment

Figure 19:
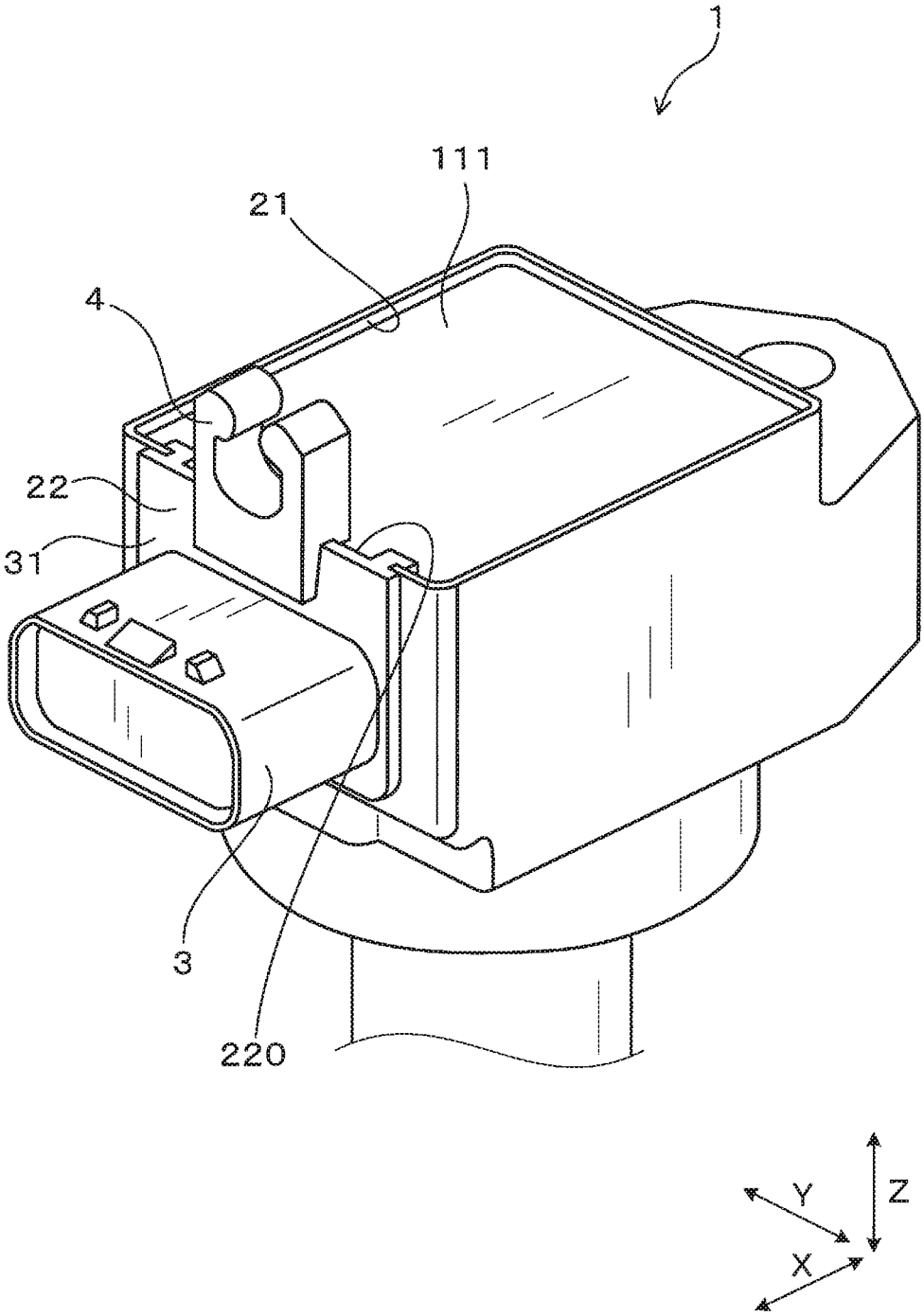
FIG. 19 is a perspective view which illustrates an ignition coil in the seventh embodiment.

FIG. 19 illustrates the retainer 4 according to the fourth embodiment which is different in configuration and layout thereof from that in the first embodiment.

The attachment wall 22 on which the retainer 4 is fit is, as can be seen in FIG. 19, a wall joined to the opening portion 21 of the case 2, i.e., the attachment wall 31 of the connector 3 in this embodiment. The opening portion 21 that is formed by the upper end portions of the side walls 201, and the upper end portion of the attachment wall 31, as already described in the first embodiment, define the resin-exposing opening portion 220 extending around the entire circumference of the exposed surface 111. The retainer 4 is, like in the first embodiment, discrete from the walls forming the resin-exposing opening portion 220 and fitted on the attachment wall 22 from above the resin-exposing opening portion 220. The retainer 4 is secured to a middle portion of the attachment wall 31 in the lateral direction Y.

Figure 20:
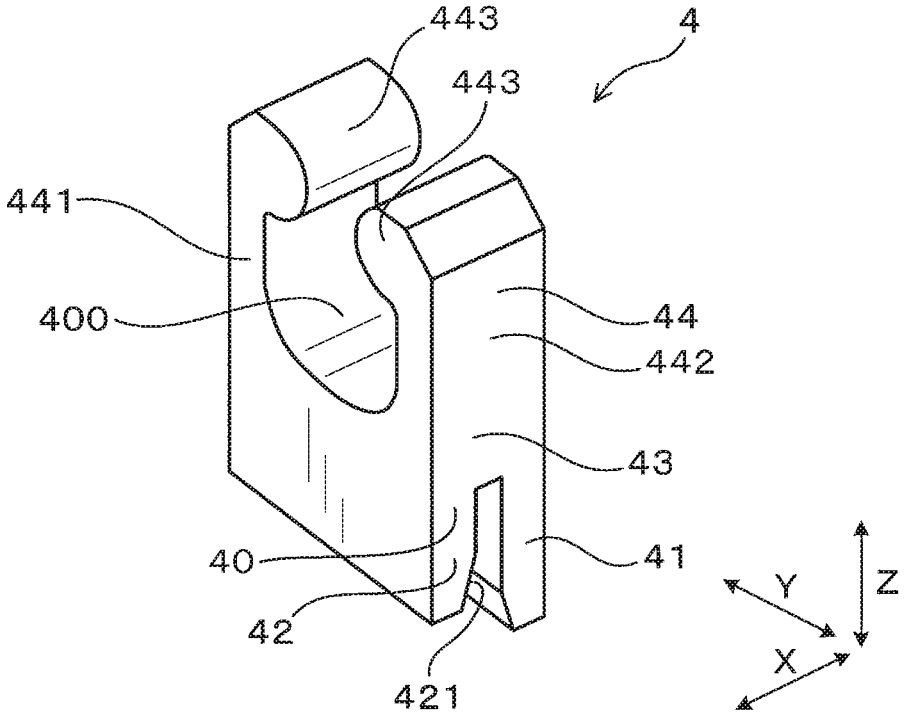
FIG. 20 is a perspective view which illustrates a retainer in the seventh embodiment.

The retainer 4, as illustrated in FIG. 20, includes the first portion 41, the second portion 42, the third portion 43, and the fourth portions 44. The first portion 41 has a lower end located below a lower end of the second portion 42 in the vertical direction Z. The second portion 42 has a lower end equipped with the tapered surface 421 which faces the attachment wall 22 (i.e., the first portion 41). The tapered surface 421 is located farther away from the attachment wall 22 as approaching a lower tip of the second portion 42.

The fourth portions 44 extend upward from the clip 40 made up of the first portion 41, the second portion 42, and the third portion 43. The fourth portions 44 include a pair of vertical sections 442 each of which extends upward from upper ends of the first portion 41, the second portion 42, and the third portion 43 which are aligned in the longitudinal direction X. The vertical sections 442 are located at ends of width of the retainer 4 which are opposed to each other in the lateral direction Y. The fourth portions 44 also include the bulges 443 which protrude from upper ends of the vertical sections 442 close to each other in the lateral direction Y. The gripper 400 is of a U-shaped made up of the upper end of the clip 40 and the fourth portions 44 and has an opening facing upward in the vertical direction Z. The gripper 400 has formed therein an inner void opening at ends thereof opposed to each other in the longitudinal direction X. Each of the fourth portions 44 has a width greater than those of the first portion 41, the second portion 42, and the third portion 43.

Other arrangements are identical with those in the first embodiment.

The seventh embodiment offers substantially the same other beneficial advantages as those in the first embodiment.

Eighth Embodiment

Figure 21:
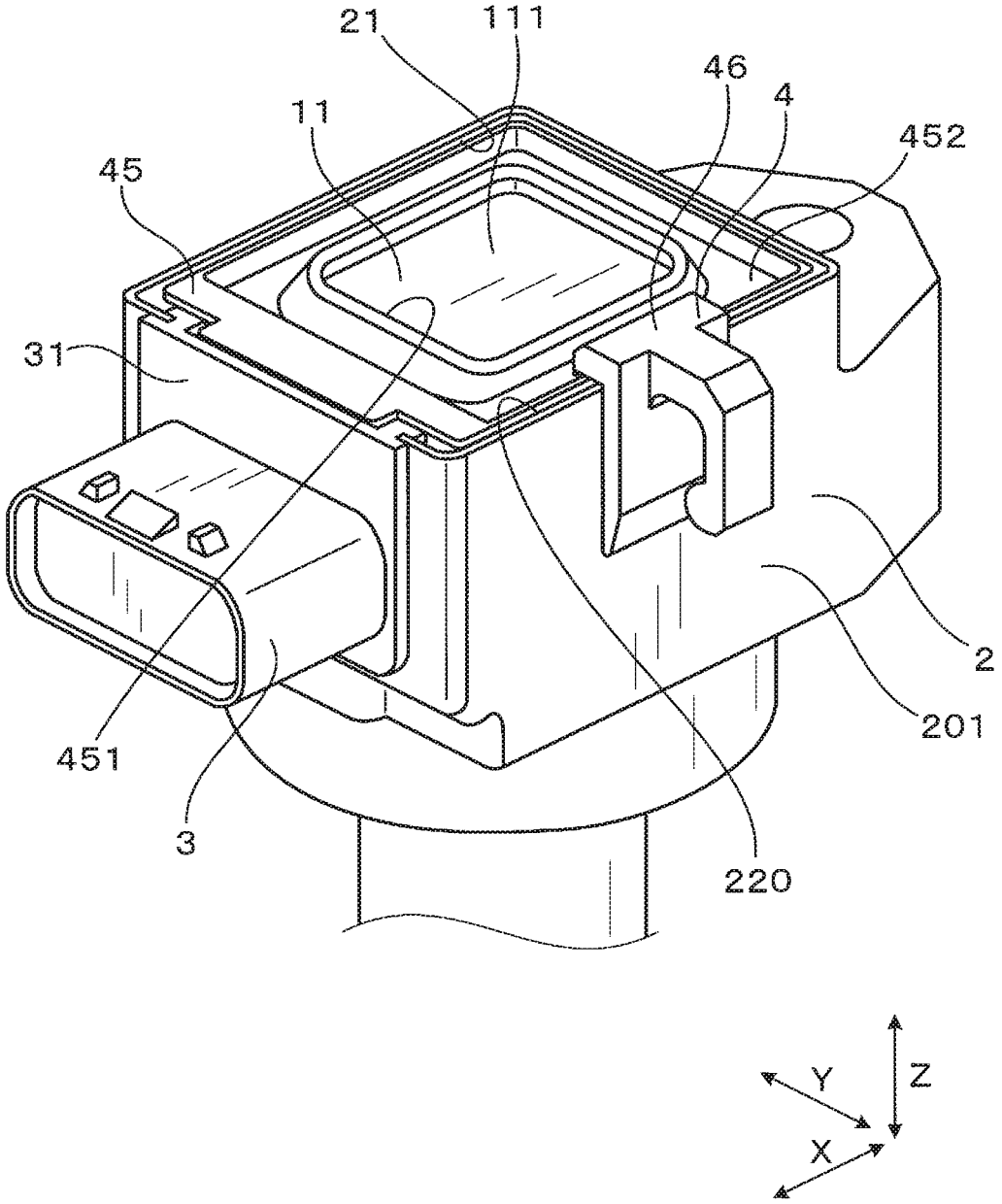
FIG. 21 is a perspective view which illustrates an ignition coil in the eighth embodiment.
Figure 22:
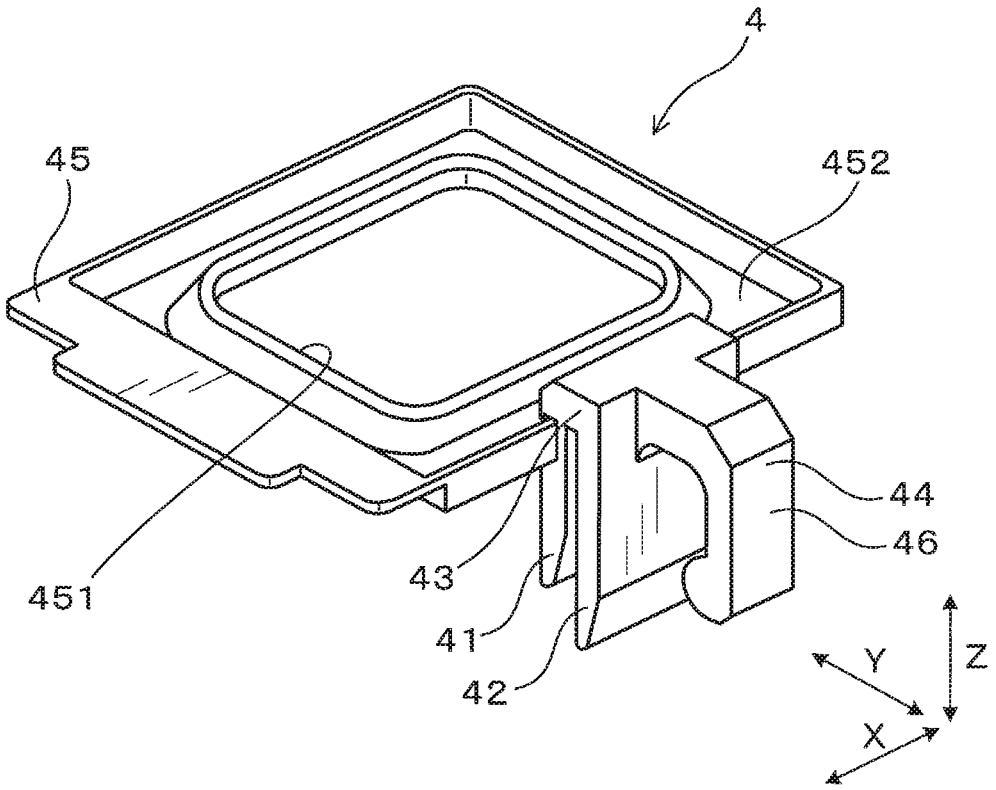
FIG. 22 is a perspective view which illustrates a retainer in the eighth embodiment.

FIGS. 21 and 22 illustrate the retainer 4 according to the eighth embodiment which is formed integrally with a component part of the ignition coil 1 which is installed in the case 2. The retainer 4 includes the cover 45 and the holder 46 which firmly retains the external connecting member 100, not shown in FIGS. 21 and 22. FIG. 22 shows an entire structure of the retainer 4.

The cover 45, as clearly illustrated in FIG. 21, is disposed to partially extend over the exposed surface 11 of the resinous member 11 so that the exposed surface 11 is exposed upward outside the resin-exposing opening portion 220. The cover 45 has formed therein the opening 451 passing through a middle portion thereof in the vertical direction Z. The cover 45 is, therefore, formed in a substantially annular shape. The cover 45 also has formed therein the groove 452 recessed downward between the opening 451 and the circumference of the cover 45. When the material of the resinous member 11 is casted into the cover 45, the cover 45 serves to minimize the amount of material of the resinous member 11 leaking outside the case 2 before the material of the resinous member 11 is hardened.

The cover 45 may be designed to have a structure, as taught in Japanese Patent First Publication No. 2016-058491 assigned to the same assignee as that of this case, the disclosure of which is incorporated herein by reference.

The retainer 4 is, as illustrated in FIG. 21, equipped with the holder 46. The holder 46 is fit on one of the side walls 201 which faces in the lateral direction Y. The holder 46, as can be seen in FIG. 22, has substantially the same configuration as that of the retainer 4 in the first embodiment, but the first portion 41, the second portion 42, and the third portion 43 each have a width greater than that of the fourth portion 44. The cover 45 extends from an upper end of the first portion 41 to inside the case body 20.

The retainer 4 is, like in the above embodiment, discrete from a wall of the case 2 (i.e., the side walls 201) constituting the resin-exposing opening portion 220. The retainer 4 is fitted on the attachment wall 22 from above the resin-exposing opening portion 220.

As apparent from the above discussion, the retainer 4 of the ignition coil 1 of this embodiment is designed to include the cover 45, thus resulting in a decrease in number of parts of the ignition coil 1.

Other arrangements are identical with those in the first embodiment.

Ninth Embodiment

Figure 23:
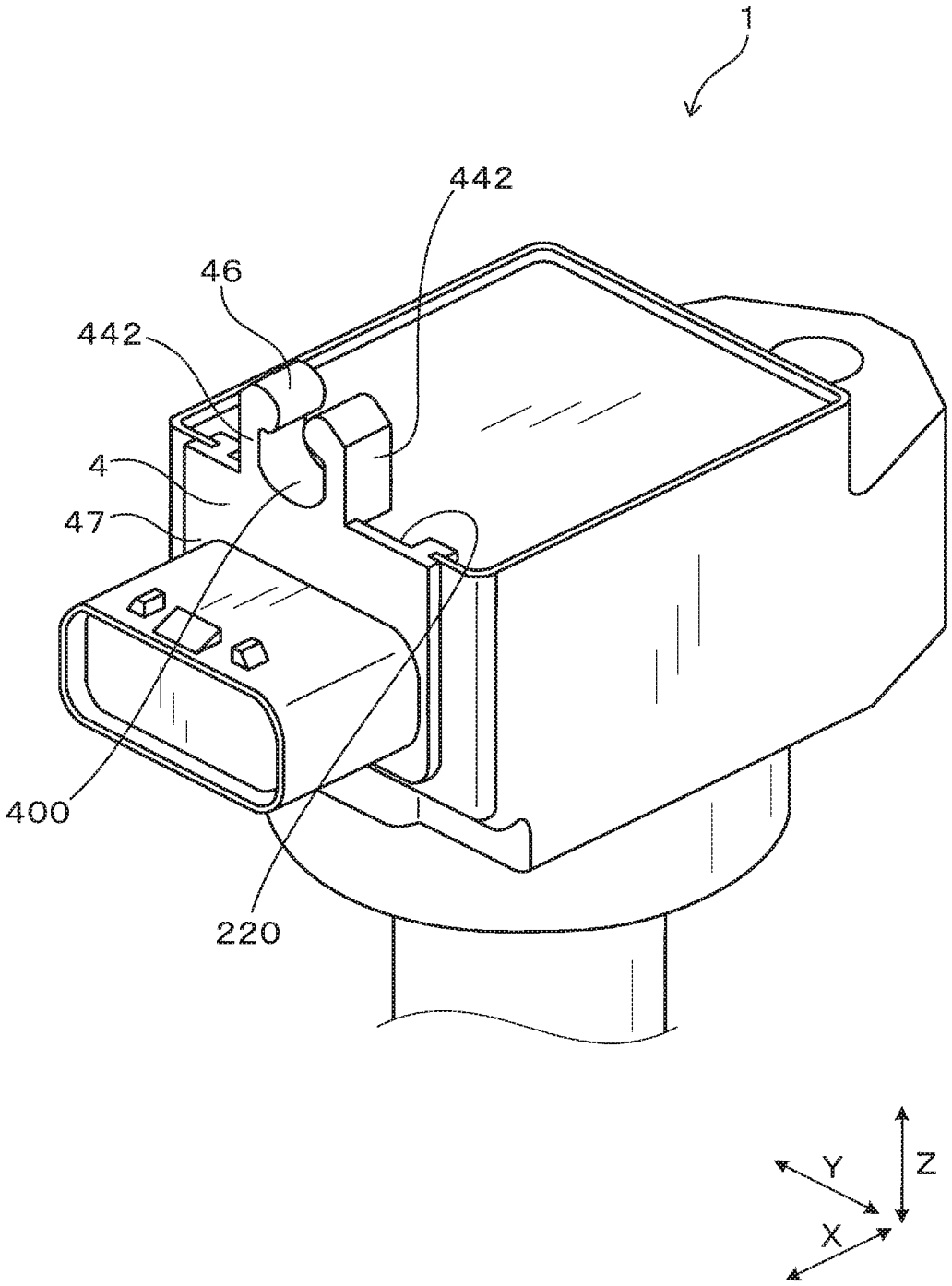
FIG. 23 is a perspective view which illustrates an ignition coil in the ninth embodiment.
Figure 24:
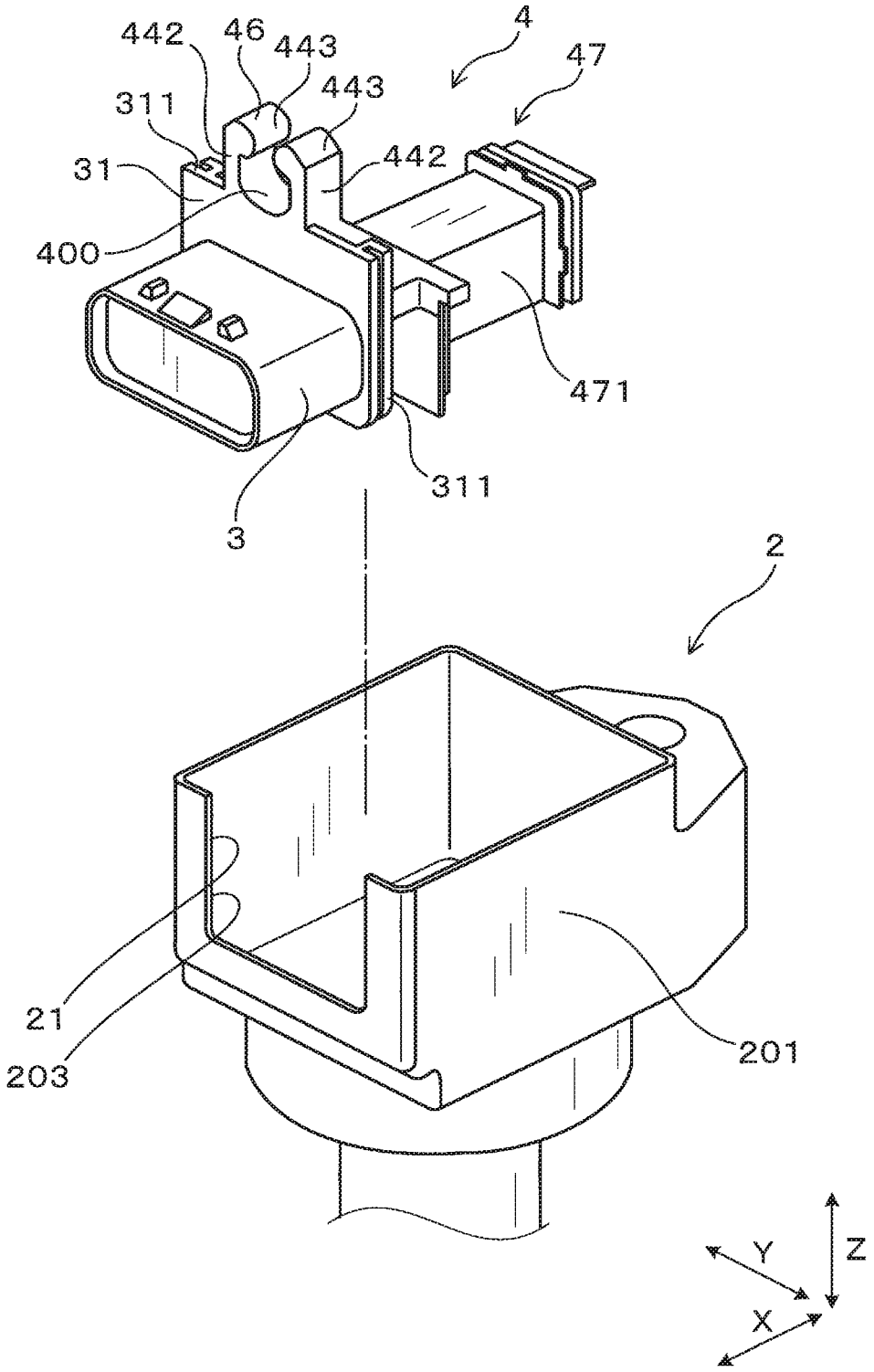
FIG. 24 is an exploded perspective view which illustrates a retainer and a case in the ninth embodiment.

FIGS. 23 and 24 illustrate the ignition coil 1 according to the ninth embodiment which is equipped with the retainer 4 which is equipped with the retainer 4 formed integrally with one of component parts of the ignition coil 1 which is secured to the case 2. The retainer 4 includes the holder 46 which retains the connector module 47 and the external connecting member 100, not shown in FIGS. 23 and 24. FIG. 24 is an exploded perspective view which shows an entire structure of the retainer 4.

The connector module 47 is, as clearly illustrated in FIG. 24, equipped with the connector 3 and the primary bobbin 471 formed integrally with the connector 3. The primary bobbin 471 is made from an electrical insulating resin and has a primary winding wound around an outer periphery thereof. The connector 3 includes the attachment 31 with the groove 311. The connector module 47 is fit on the fitting opening 203 which partially constitutes the opening portion 21 of the side wall 201 of the case 2. Specifically, the groove 311 of the attachment wall 31 is fit on the edge of the fitting opening 203, thereby securing the whole of the retainer 4 equipped with the connector module 47 and the holder 46 to the wall of the case 2.

The connector module 47 may be designed to have the same structure, as taught in Japanese Patent First Publication No. 2017-045760 or Japanese Patent First Publication No. 2017-059681, the disclosures of which are incorporated herein by reference.

The holder 46 includes a pair of vertical sections 442 and a pair of bulges 443. The vertical sections 442 extend upward from the upper end of the attachment wall 31. The bulges 443 are formed on upper ends of the vertical sections 442 and protrude closer to each other in the lateral direction Y. The holder 46 is of a U-shape with opening facing upward. The holder 46 works as a gripper and has an inner void opening at ends thereof opposed to each other in the longitudinal direction X. The attachment of the external connecting member 100, not shown, to the retainer 4 is achieved by snap-fitting the external connecting member 100 in the holder 46.

In this embodiment, the retainer 4 itself, as can be seen in FIG. 23, forms a portion of the resin-exposing opening portion 220. Other arrangements are identical with those in the first embodiment.

The retainer 4 is equipped with the connector module 47, thus resulting in a decrease in number of parts of the ignition coil 1.

Tenth Embodiment

FIGS. 25 to 28 illustrate the ignition coil 1 according to the tenth embodiment which is equipped with the retainer 4 formed integrally with one of component parts of the ignition coil 1 which is secured to the case 2.

Figure 25:
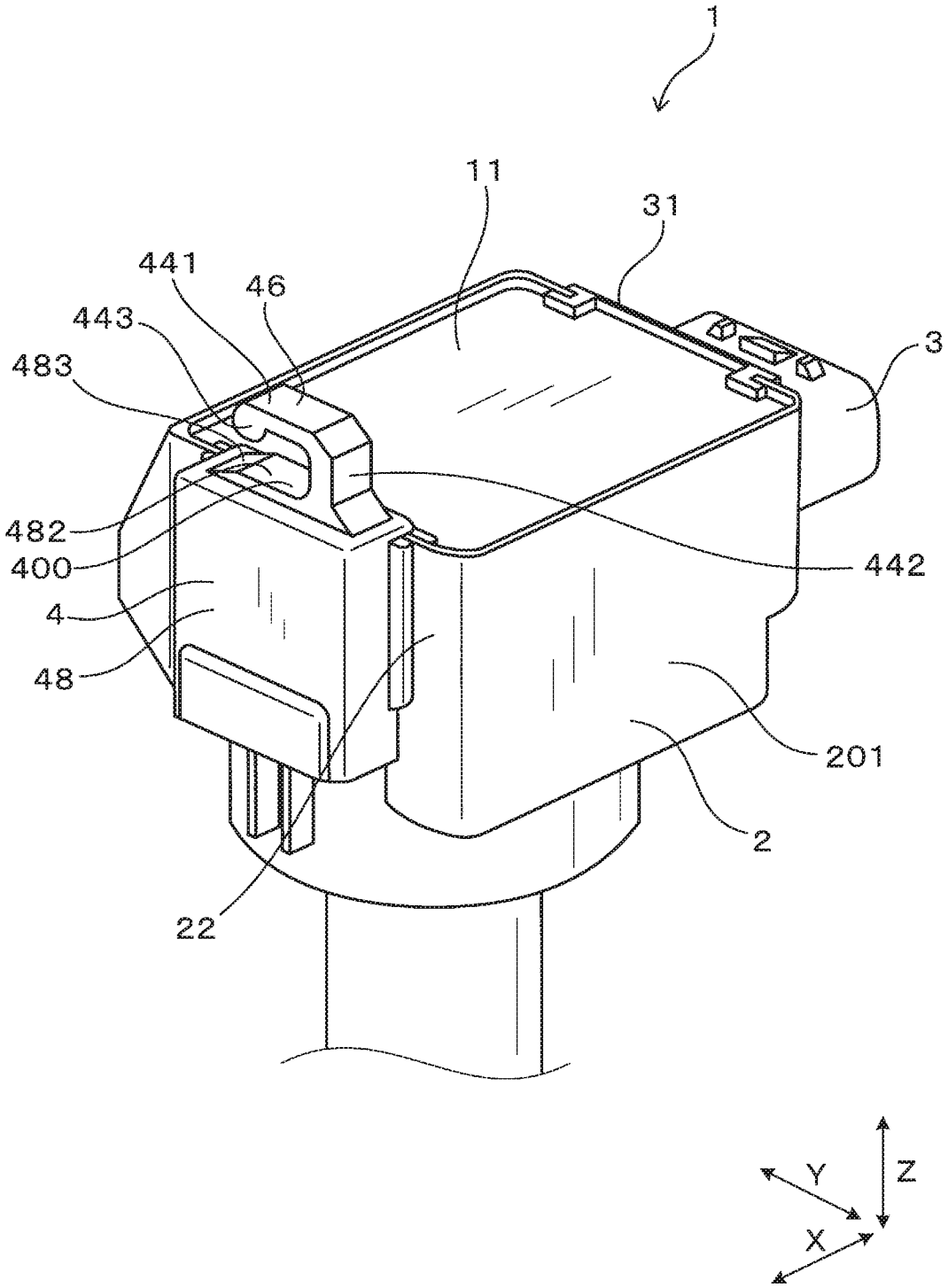
FIG. 25 is a perspective view which illustrates an ignition coil in the tenth embodiment.
Figure 26:
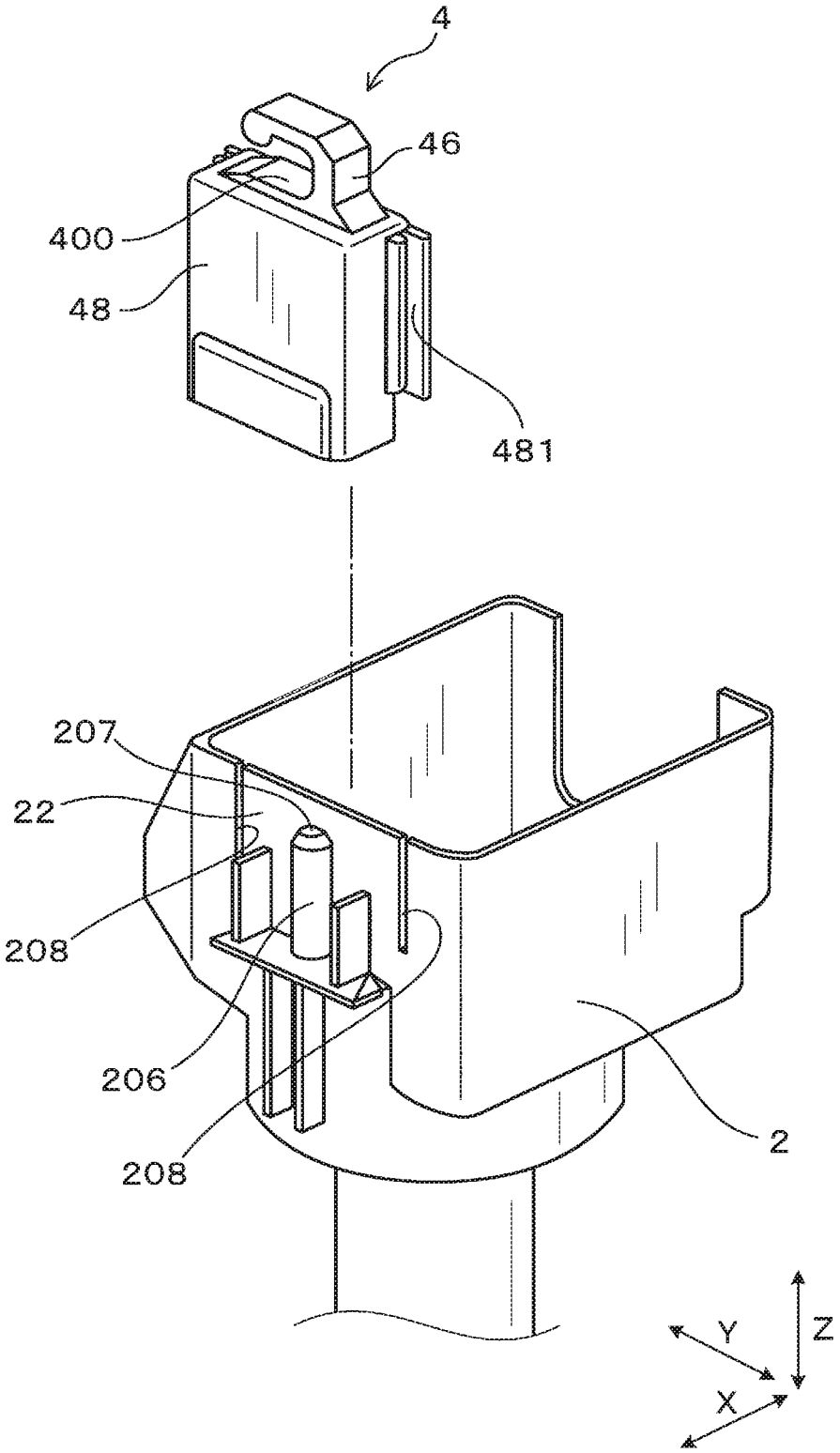
FIG. 26 is an exploded perspective view which illustrates a retainer and a case in the tenth embodiment.
Figure 27:
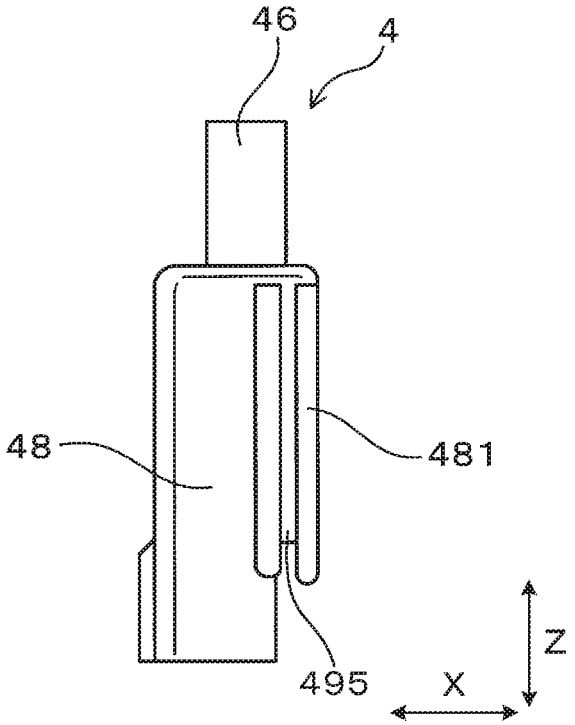
FIG. 27 is a side view which illustrates a retainer in the tenth embodiment.
Figure 28:
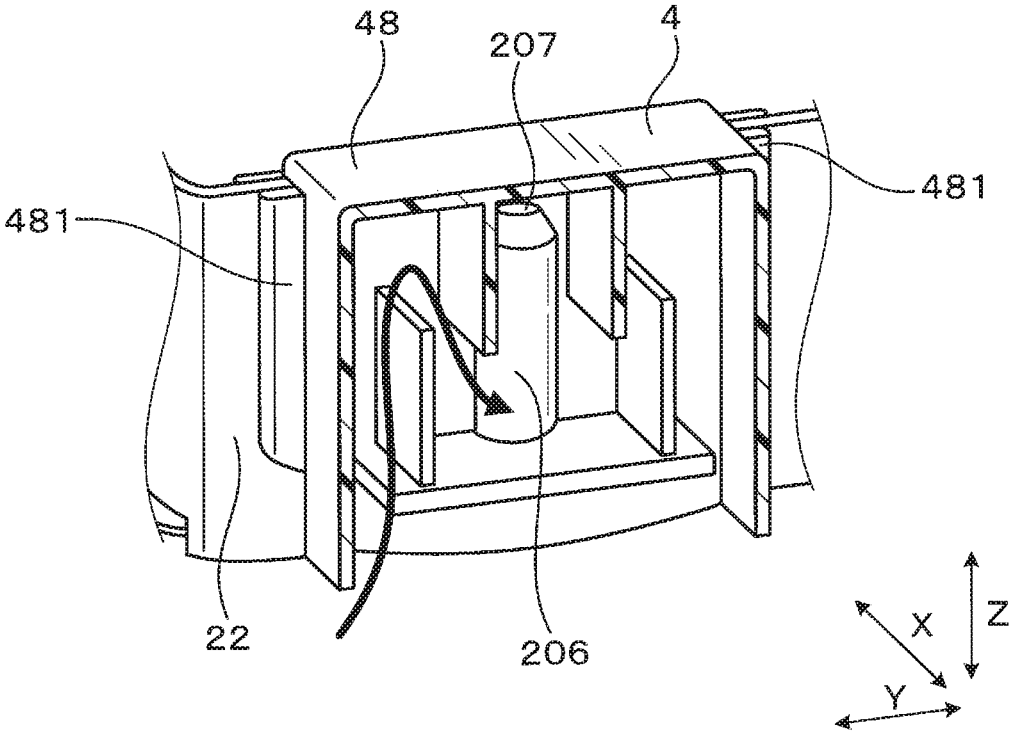
FIG. 28 is a perspective sectional view which illustrates an inside of a water cover in the tenth embodiment.

The retainer 4 includes the water cover 48 and the holder 46 which retains the external connecting member 100, not shown in FIGS. 25 to 28. FIG. 26 shows an entire structure of the retainer 4. FIG. 28 omits the holder 46 for brevity of illustration.

The case 2, as clearly illustrated in FIG. 25, includes the attachment wall 22 which is opposed to the side wall 201 of the case 2 in which the attachment wall 31 of the connector 3 is fit in the longitudinal direction X. The attachment wall 22, as illustrated in FIG. 26, includes the pole 206 which bulges outward in the longitudinal direction X. The pole 206 has formed therein the breathing opening 207 extending through a length thereof in the vertical direction Z. The breathing opening 207, although not illustrated, communicates with a breathing path extending between the case and a sealing rubber serving to create a liquid-tight seal between the case 2 and the internal combustion engine.

The attachment wall 22, as clearly illustrated in FIG. 26, has formed therein a pair of slits 208 which are located on opposite sides of the pole 206 in the lateral direction Y. Each of the slits 208 has a given length extending downward from an upper edge of the attachment wall 22 in the vertical direction Z.

The water cover 48, as illustrated in FIGS. 25 to 27, includes the sealing portions 481 formed in the shape of a groove which has a U-shaped cross section. The sealing portions 481 are arranged on side wall of the water cover 48 which are opposed to each other in the lateral direction Y. Each of the sealing portion 481, as can be seen in FIG. 27, has the bottom wall 495 which is tightly fit in one of the slits 208 to hermetically seal the slit 208. Each of the sealing portions 481 is, as can be seen in FIGS. 25 and 28, partially located inside the case 2.

The water cover 48 is, as illustrated in FIG. 25, secured to the attachment wall 22 so that the resinous member 11 is placed in contact continuously with the part of the sealing portion 481 located inside the case 2 and the attachment wall 22. The sealing portion 481 of the retainer 4 is partially embedded in the resinous member 11.

The sealing portion 481 is fit on the case 2, thereby completing the resin-exposing opening portion 220. In other words, the retainer 4 itself forms a part of the resin-exposing opening portion 220.

The water cover 48 is, as clearly illustrated in FIG. 28, arranged to surround the pole 206 and cover the upper end of the breathing opening 207. The plug hole of the internal combustion engine communicates with the outside air through the inside chamber of the water cover 48, the breathing opening 207 of the pole 206, and the breathing path. The air path extending from outside the water cover 48 to the pole 206 is, as indicated by an arrow in FIG. 28, waved vertically, thereby minimizing a risk that water flows from outside the water cover 48 into the breathing opening 207 of the pole 206.

The waver cover 48 may be designed to have a structure, as taught in Japanese Patent First Publication No. 2012-186411, disclosure of which is incorporated herein by reference.

The holder 46, as illustrated in FIG. 25, protrudes upward from the upper end of the water cover 48. The holder 46 serves as a retainer including the bulging section 482 formed on substantially an entire upper surface of the water cover 48, the vertical section 442 extending upward from the bulging portion 452, and the lateral section 441 extending from the upper end of the vertical section 442 in the lateral direction Y. The lateral section 441 has formed on an end thereof the bulge 443 protruding downward. The holder 46 is, therefore, of a U-shape with an opening facing in the lateral direction Y. The holder 46 has an inner void opening at ends thereof opposed to each other in the longitudinal direction X. The external connecting member 100, not shown, is snap-fitted in the holder 46. The bulging section 482 has an end with the tapered surface 483 facing the opening of the holder 46. The tapered surface 483 slants downward toward the tip of the bulging section 482, in other words, away from the vertical section 442. The tapered surface 483 serves to facilitate snap-fitting of the external connecting member 100 into the holder 46.

Other arrangements are identical with those in the first embodiment.

The retainer 4 is, as described above, equipped with the water cover 48, thus enabling the number of parts of the ignition coil 1 to be decreased.

Eleventh Embodiment

Figure 29:
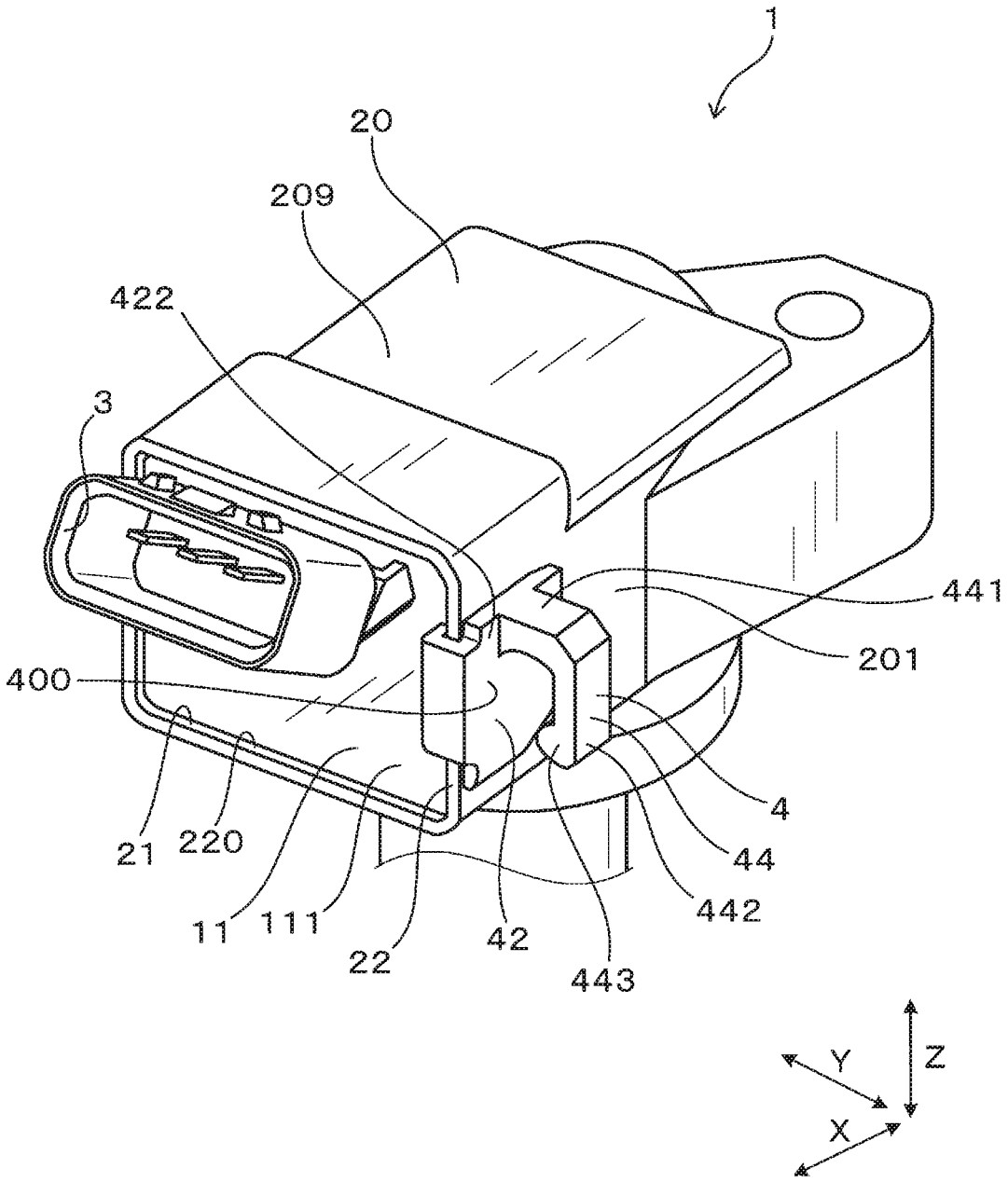
FIG. 29 is a perspective view which illustrates an ignition coil in the eleventh embodiment.
Figure 30:
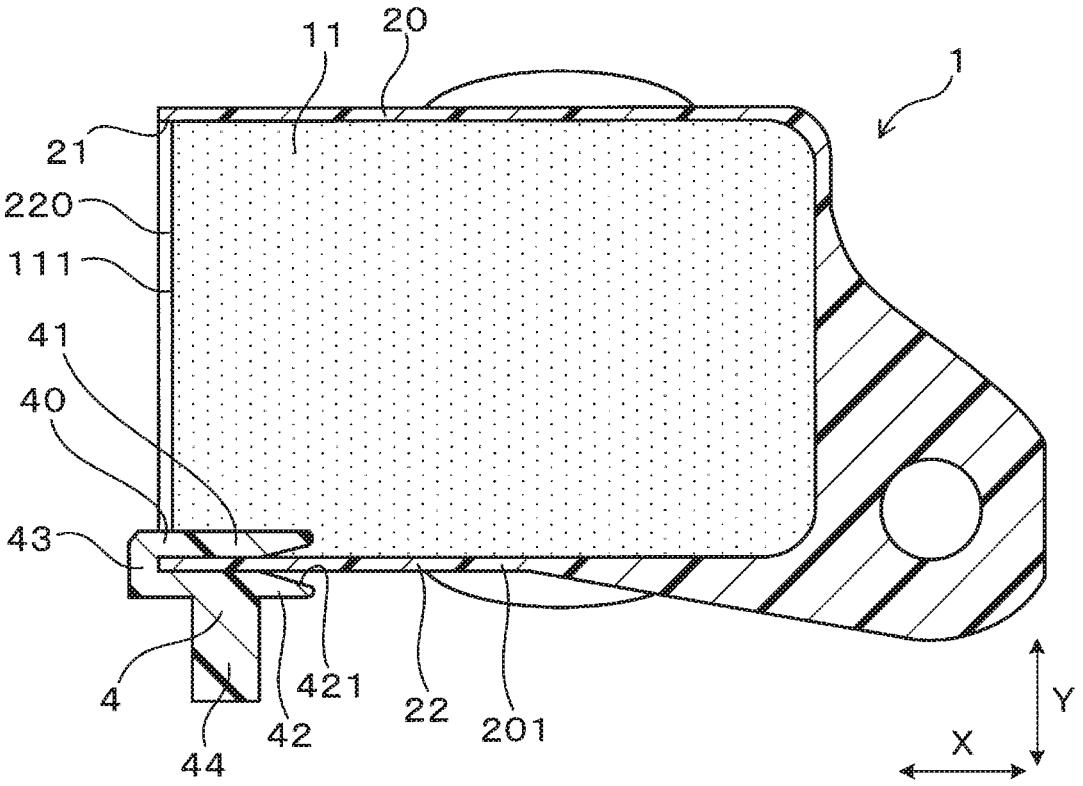
FIG. 30 is a transverse sectional view of an ignition coil in the eleventh embodiment.

FIGS. 29 and 30 illustrate the ignition coil 1 according to the eleventh embodiment which is different in location or orientation of the resin-exposing opening portion 220 from the first embodiment. FIG. 30 omits component parts of the ignition coil 1 disposed inside the case body 20 and connectors for brevity of illustration.

The side wall 201 of the case 2 has the opening portion 21 which protrudes toward the connector 3 in the longitudinal direction X. The upper ends of the side walls 201 are closed by the ceiling wall 209. The ends of the bottom wall 202, the side walls 201, and the ceiling wall 209 which face the connector 3 in the longitudinal direction X form the opening portion 21. The opening portion 21 extends along an entire circumference of the exposed surface 111 of the resinous member 11. The opening portion 21 in this embodiment is shaped as the resin-exposing opening portion 220 which exposes or orients the surface 111 of the resinous member 11 toward the connector 3 in the longitudinal direction X. Specifically, the resin-exposing opening portion 220 defines an opening facing the connector 3 in the longitudinal direction X.

The retainer 4 is fitted from outside the resin-exposing opening portion 220 in the longitudinal direction X on the attachment wall 22 that is one of the side walls 201 which faces in the lateral direction Y.

The retainer 4, as can be seen in FIG. 30, includes the first portion 41, the second portion 42, the third portion 43, and the fourth portion 44. The clip 40 made up of the first portion 41, the second portion 42, and the third portion 43 is of a U-shape with an opening facing in a direction opposite a direction in which the connector 3 protrudes from the case 2 in the longitudinal direction X. The clip 40 has an inner void extending through a width thereof in the vertical direction Z.

The second portion 42 has the large-width portion 422 which is located farther away from the connector 3 than the third portion 43 is in the longitudinal direction X. The large-width portion 422 is a part of the second portion 42 which is wider than the rest of the second portion 42. The width of each of the first portion 41, the second portion 42, and the third portion 43 which form the clip 40, as referred to herein, is a maximum dimension of the clip 40 in direction (i.e., the vertical direction Z) perpendicular to a U-shaped transverse cross section of the clip 40. In other words, the width of the second portion 42 is a dimension or length of the large-width portion 422 in the vertical direction Z. The width of the second portion 42 is set greater than those of the first portion 41 and the third portion 43. The first portion 41 has the same width as that of the third portion 43.

The joint of the retainer 4 to the attachment wall 22 is achieved by press-fitting the attachment wall 22 into the clip 40. The second portion 42 has the end with the tapered surface 421 which is farther away from the third portion 43 (i.e., the connector 3) in the longitudinal direction X. The tapered surface 421 faces the attachment wall 22 and slants farther away from the attachment wall 22 as approaching the tip of the second portion 42.

The fourth portion 44, as clearly illustrated in FIG. 29, extends from the upper end of the large-width portion 422. The second portion 42 and the fourth portion 44 form the gripper 400. The gripper 400 is of a U-shape with an opening facing downward. The gripper 400 is shaped to have an inner void opening at ends thereof opposed to each other in the longitudinal direction X, in other words, extending through a width thereof in the longitudinal direction X. The holding of the external connecting member 100, not shown, in the retainer 4 is achieved by snap-fitting the external connecting member 100 in the gripper 400 from below it.

The width of the fourth portion 44 is smaller than those of the first portion 41, the second portion 42, and the third portion 43. The width of the fourth portion 44, as referred to herein, is a maximum dimension thereof in a direction (i.e., the longitudinal direction X) in which a combination of a portion of the clip 40 and the fourth portion 44 is viewed to be of a U-shape.

Other arrangement are identical with those of the first embodiment.

The eleventh embodiment offers substantially the same other beneficial advantages as those in the first embodiment.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

The retainer 4 in the first embodiment is shaped so that the attachment wall 22 is pressed thereinto, but may alternatively be designed to have the first portion 41 and the second portion 42 which are arranged at an interval away from each other which is greater than the thickness of the attachment wall 22, so that the attachment wall 22 is loose-fit in the retainer 4. In this case, the retainer 4 is hooked on the case 2 and has the first portion 41 partially embedded in the resinous member 11, thereby firmly securing the retainer 4 to the case 2. This structure may be used in the other embodiments.

The retainer 4 may alternatively be made from material other than that described above when needed. For instance, the retainer 4 may be made of material which exhibits close adhesion with the resinous member 11 in order to enhance the attachment of the retainer 4 to the resinous member 11. The retainer 4 may alternatively be made from material which facilitates separation of the retainer 4 from the resinous member 11 in order to decrease stress exerted by the retainer 4 on the resinous member 11 to minimize a risk that the resinous member 11 is cracked.

The retainer 4 in the first embodiment may be designed to have formed on at least one of the first portion 41 and the second portion 42 a protrusion(s) which is pressed against the other in order to facilitate press-fitting of the attachment wall 22 into the retainer 4. The attachment wall 22 may have formed therein a recess(es) in which the protrusion is fit. The ignition coil 1 in the other embodiments may be modified in the above way.

The first portion 41 in the first to eighth and eleventh embodiments may be shaped to have a thickness (i.e., a dimension in the lateral direction Y) less than that of the second portion 42. This results in a decrease in volume of a portion of the first portion 41 arranged inside the case 2 to avoid physical interference of the retainer 4 with parts disposed in the case 2.

What is claimed is:

1. An ignition coil for an internal combustion engine comprising:

a case in which component parts are disposed and which has an opening portion;

a connector which is used to achieve an electrical connection with an external device;

a resinous member which is disposed in the case; and a retainer which retains an external connecting member joined to the connector, wherein the retainer is mechanically discrete from the case and also from the connector and secured to an attachment wall that is at least one of a wall of the case which constitutes the opening portion and a wall attached to the opening portion, wherein a portion of the retainer is embedded in the resinous member, wherein the ignition coil further comprises a resin-exposing opening portion which is defined by at least a part of the opening portion and exposes an exposed surface of the resinous member, the resin-exposing opening portion extending around an entire circumference of the exposed surface, and wherein the retainer is mechanically discrete from the wall of the case constituting the resin-exposing opening portion, the retainer being secured from the resin-exposing opening portion to the attachment wall constituting the resin-exposing opening portion, and wherein the retainer includes a clip formed by a first portion, a second portion, and a third portion, the first portion being disposed inside the case and at least partially embedded in the resinous member, the second portion holding the attachment wall along with the first portion, the third portion connecting between the first portion and the second portion and being located on an opened end of the resin-exposing opening portion of the attachment wall, the clip being of a U-shape and opening facing in a direction farther away from the opened end of the resin-exposing opening portion, and wherein the retainer also includes a fourth portion which constitutes a gripper which is of a U-shape and retains the external connecting member.

2. The ignition coil for an internal combustion engine as set forth in claim 1, wherein at least one of the first, second, third, and fourth portions has a width different from those of the others.

3. The ignition coil for an internal combustion engine as set forth in claim 1, wherein the retainer is formed integrally with a component part of the ignition coil which is secured to the case.

4. The ignition coil for an internal combustion engine as set forth in claim 1, wherein the retainer is press-fitted on the attachment wall.

5. The ignition coil for an internal combustion engine as set forth in claim 1, wherein the retainer is separate from the connector, and the connector is attached to the case.

6. The ignition coil for an internal combustion engine as set forth in claim 1, wherein:

the retainer including the U-shaped clip is formed by the first portion, the second portion, and the third portion, and the first and second portions respectively form legs of the U-shaped clip, and the third portion connects the first and second portions.

7. The ignition coil for an internal combustion engine as set forth in claim 1, wherein the retainer constituting the U-shaped clip has an opening facing in a direction opposite the opening portion.

8. The ignition coil for an internal combustion engine as set forth in claim 1, wherein:

the attachment wall forms a first side wall of the case;

the case includes a second side wall which is perpendicular to the first side wall of the case; and an opening is defined in the second side wall and engages an attachment wall of the connector such that the attachment wall of the connector is perpendicular to the first side wall of the case.

9. An ignition coil for an internal combustion engine comprising:

a case in which component parts are disposed and which has an opening portion;

a connector which is used to achieve an electrical connection with an external device;

a resinous member which is disposed in the case; and a retainer which retains an external connecting member joined to the connector, wherein:

the retainer is mechanically discrete from the case and also from the connector and secured to an attachment wall that is at least one of a wall of the case which constitutes the opening portion and a wall attached to the opening portion, a portion of the retainer is embedded in the resinous member, the attachment wall forms a first side wall of the case, the case includes a second side wall which is perpendicular to the first side wall of the case, and an opening is defined in the second side wall and engages an attachment wall of the connector such that the attachment wall of the connector is perpendicular to the first side wall of the case.

* * * * *